US011207793B2

(12) United States Patent
Howard et al.

(10) Patent No.: US 11,207,793 B2
(45) Date of Patent: Dec. 28, 2021

(54) HYDRO-MECHANICAL CUTTER

(71) Applicants: Lamb Weston, Inc., Eagle, ID (US); Lamb-Weston/Meijer V.O.F., PJ Kruiningen (NL)

(72) Inventors: Grayden Howard, Richland, WA (US); Samuel Monk, Richland, WA (US); Tayler Wonders, Kennewick, WA (US); Mark Alan Fow, Kennewick, WA (US); Dirk Jacob Van Dijk, Veghel (NL)

(73) Assignees: Lamb Weston, Inc., Eagle, ID (US); Lamb-Weston/Meijer V.O.F., PJ Kruiningen (NL)

( * ) Notice: Subject to any disclaimer, the term of this patent is extended or adjusted under 35 U.S.C. 154(b) by 0 days.

(21) Appl. No.: 16/924,453

(22) Filed: Jul. 9, 2020

(65) Prior Publication Data

US 2020/0391400 A1 Dec. 17, 2020

Related U.S. Application Data

(63) Continuation-in-part of application No. 29/694,753, filed on Jun. 13, 2019, and a continuation-in-part of (Continued)

(51) Int. Cl.

*B26D 7/06* (2006.01)
*B26D 3/11* (2006.01)

(Continued)

(52) U.S. Cl.

CPC ..... *B26D 7/0658* (2013.01); *B26D 1/03* (2013.01); *B26D 3/11* (2013.01); *B26D 7/1818* (2013.01);

(Continued)

(58) Field of Classification Search

CPC ..... B26D 1/03; B26D 2210/02; B26D 3/11; B26D 7/0658; B26D 7/1818; B26D 7/2614

See application file for complete search history.

(56) References Cited

U.S. PATENT DOCUMENTS 4,644,838 A * 2/1987 Samson ..... B26D 7/06 83/162
5,083,486 A * 1/1992 Allison ..... B26D 1/03 83/171
2018/0222075 A1 8/2018 Julian et al.

FOREIGN PATENT DOCUMENTS

CN 103817734 A 5/2014
EP 2866584 B1 5/2018

(Continued)

OTHER PUBLICATIONS

Notification of Transmittal of the Internationalsearch Report and the Written Opinion of the International Searching Authority,or the Declaration dated Oct. 30, 2020 for App. No. PCT/US2020/041330.

*Primary Examiner* — Stephen Choi
(74) *Attorney, Agent, or Firm* — Ryan T. Grace; Advent, LLP

(57) ABSTRACT

A food product cutting system can include a food product carrier for carrying food product circumferentially around an axis of rotation, where the food product carrier includes food cutters each having a knife and a corresponding pusher. Each knife is for receiving and engaging with food product, and each pusher is slidably coupled with a knife and movable for pushing food product out of engagement with the food cutter. The food product cutting system can also include a track oriented generally circularly with respect to the food product carrier. The track can be arranged at varying radial distances from the axis of rotation and coupled with followers. Each follower can be connected to a corresponding (Continued)

pusher. In operation, food product moved into the knife of a food cutter and carried around the axis of rotation is incrementally pushed out of engagement with the food cutter by the corresponding pusher.

14 Claims, 25 Drawing Sheets

Related U.S. Application Data application No. 29/694,754, filed on Jun. 13, 2019, now Pat. No. Des. 896,032, and a continuation-in-part of application No. 29/694,758, filed on Jun. 13, 2019, and a continuation-in-part of application No. 29/694,748, filed on Jun. 13, 2019, now Pat. No. Des. 896,031.

(60) Provisional application No. 62/871,911, filed on Jul. 9, 2019.

(51) Int. Cl.

| | |
|---|---|
| ***B26D 1/03*** | (2006.01) |
| ***B26D 7/18*** | (2006.01) |
| *B26D 7/26* | (2006.01) |

(52) U.S. Cl.

CPC ..... *B26D 7/2614* (2013.01); *B26D 2210/02* (2013.01)

(56) References Cited

FOREIGN PATENT DOCUMENTS

| | | |
|---|---|---|
| JP | 2010273607 A | 12/2010 |
| JP | 2012250321 A | 12/2012 |

* cited by examiner

HYDRO-MECHANICAL CUTTER

CROSS-REFERENCE TO RELATED APPLICATIONS

The present application claims the benefit under 35 U.S.C. § 119(e) of U.S. Provisional Application Ser. No. 62/871,911, filed Jul. 9, 2019, and titled "HYDRO-MECHANICAL CUTTER." The present application is also a continuation-in-part under 35 U.S.C. § 120 of U.S. patent application Ser. No. 29/694,748, filed Jun. 13, 2019, and titled "CUTTER FOR FOOD PRODUCTS;" U.S. patent application Ser. No. 29/694,753, filed Jun. 13, 2019, and titled "PUSHER FOR FOOD PRODUCTS CUTTER;" U.S. patent application Ser. No. 29/694,754, filed Jun. 13, 2019, and titled "CUTTER FOR FOOD PRODUCTS;" and U.S. patent application Ser. No. 29/694,758, filed Jun. 13, 2019, and titled "PUSHER FOR FOOD PRODUCTS CUTTER." U.S. Provisional Application Ser. No. 62/871,911 and U.S. patent application Ser. Nos. 29/694,748; 29/694,753; 29/694,754; and 29/694,758 are herein incorporated by reference in their entireties.

BACKGROUND

An increasing number of food products are processed before arriving on a consumer's plate. A variety of fruits and vegetables, for example, are cut or shaped and then frozen or otherwise preserved for later use. In order to meet the demand for processed food products and efficiently produce large quantities of such products, the food industry utilizes various equipment for rapidly processing large amounts of foodstuff.

DRAWINGS

The Detailed Description is described with reference to the accompanying figures.

Figure 1:
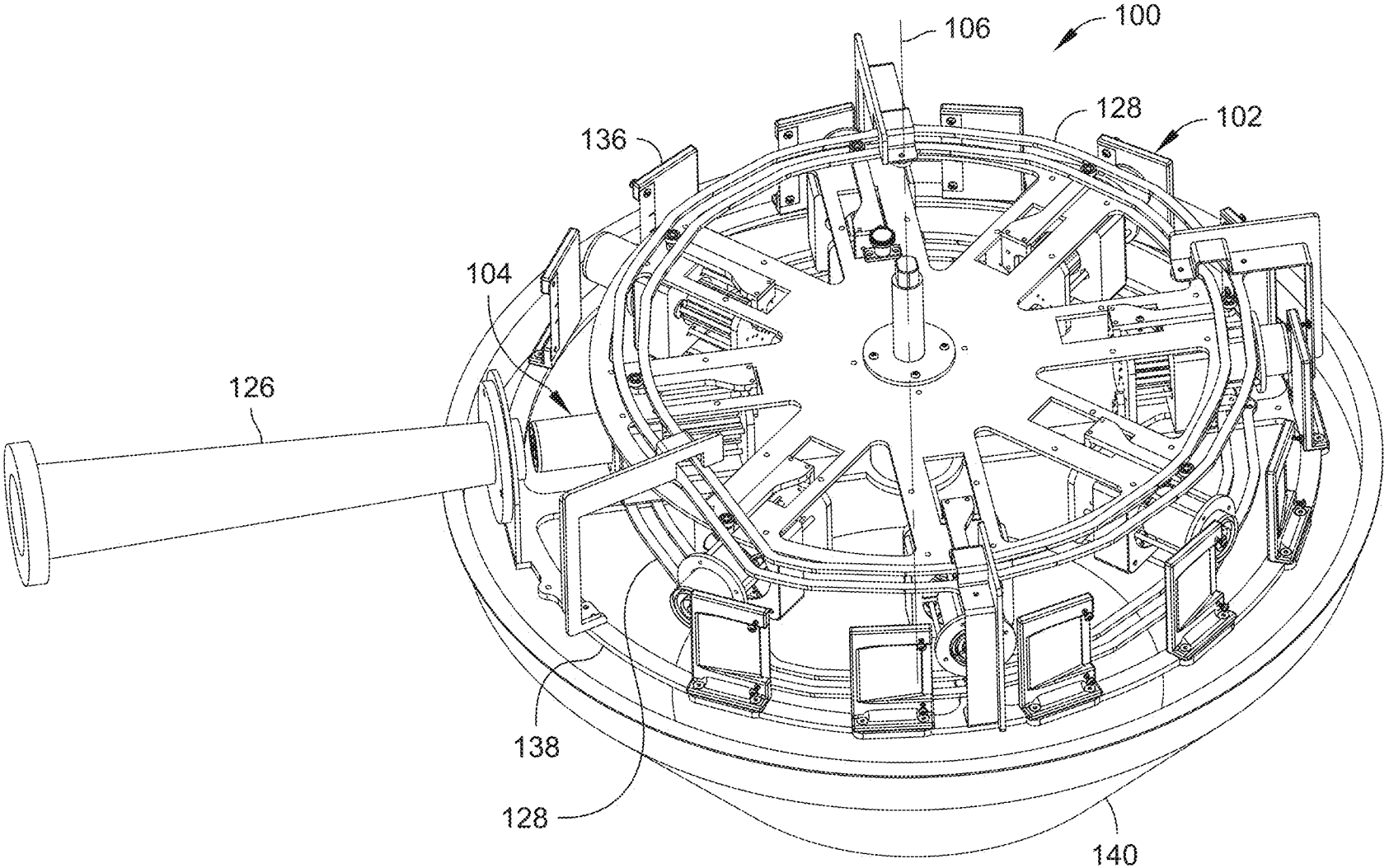
FIG. 1 is an isometric view of a food product cutting system including a rotating food product carrier with multiple food cutters, and multiple stationary slicing knives disposed in a generally tangential orientation with respect to the direction of travel of the food cutters in accordance with example embodiments of the present disclosure.
Figure 2:
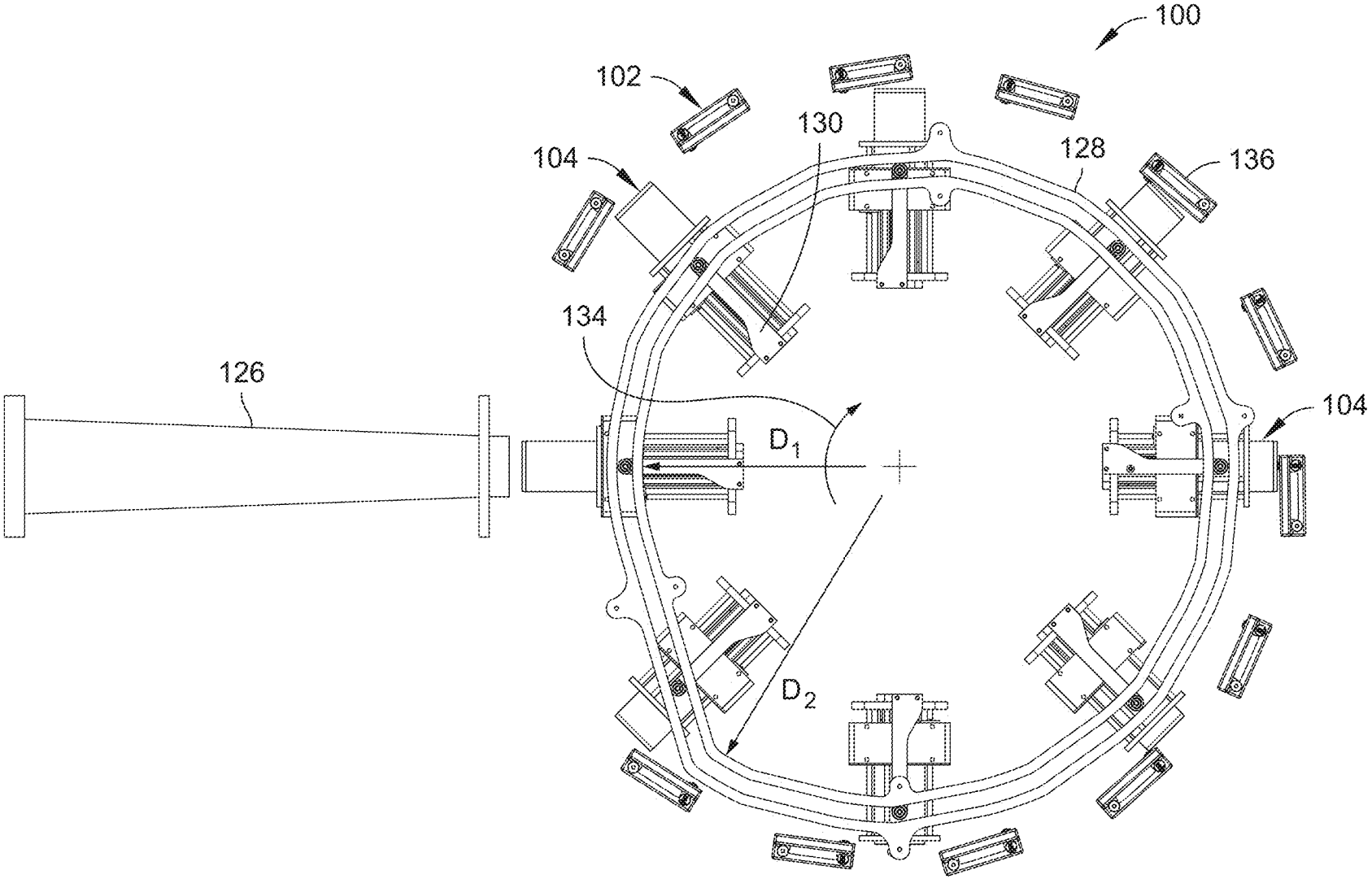
FIG. 2 is a partial top plan view of the food product cutting system illustrated in FIG. 1, where various components have been removed for clarity.
Figure 3:
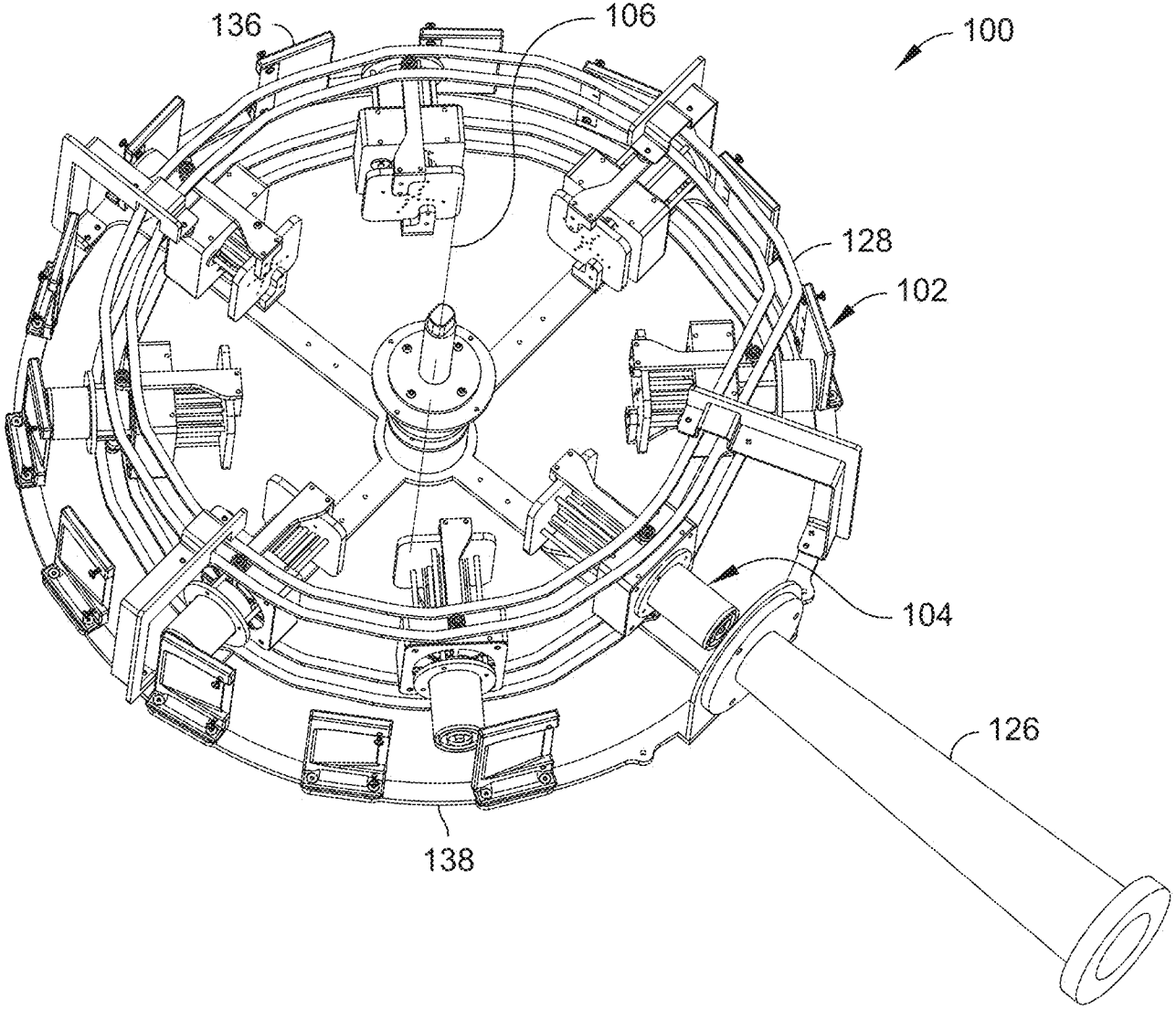
FIG. 3 is a partial perspective view of the food product cutting system illustrated in FIG. 1, where the food product cutting system is shown in an initial load position for receiving food product at a first food cutter, and where a second food cutter has already moved past a first slicing knife to create a first slice of food product.
Figure 4:
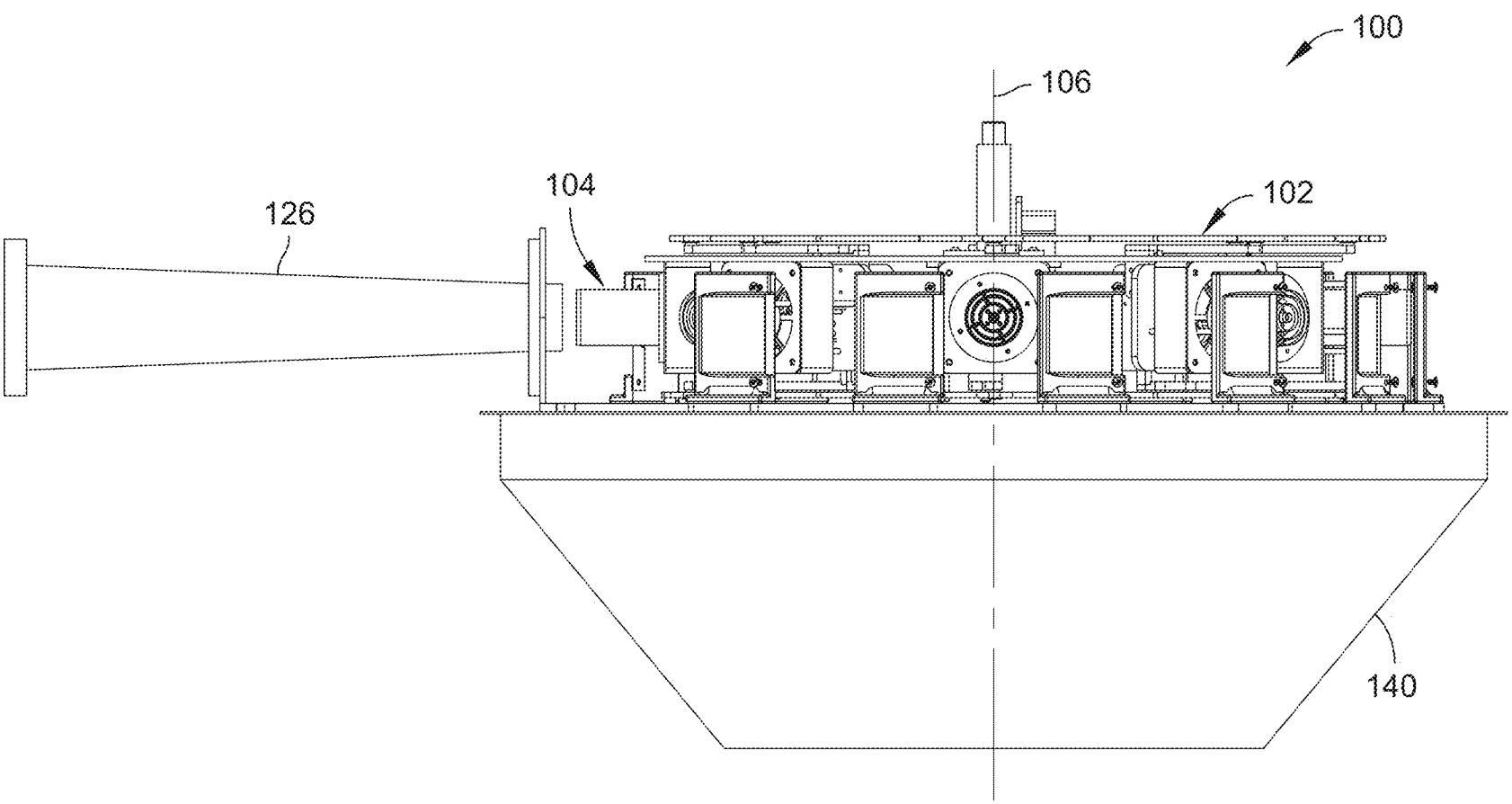
FIG. 4 is a side elevation view of the food product cutting system illustrated in FIG. 1.
Figure 5:
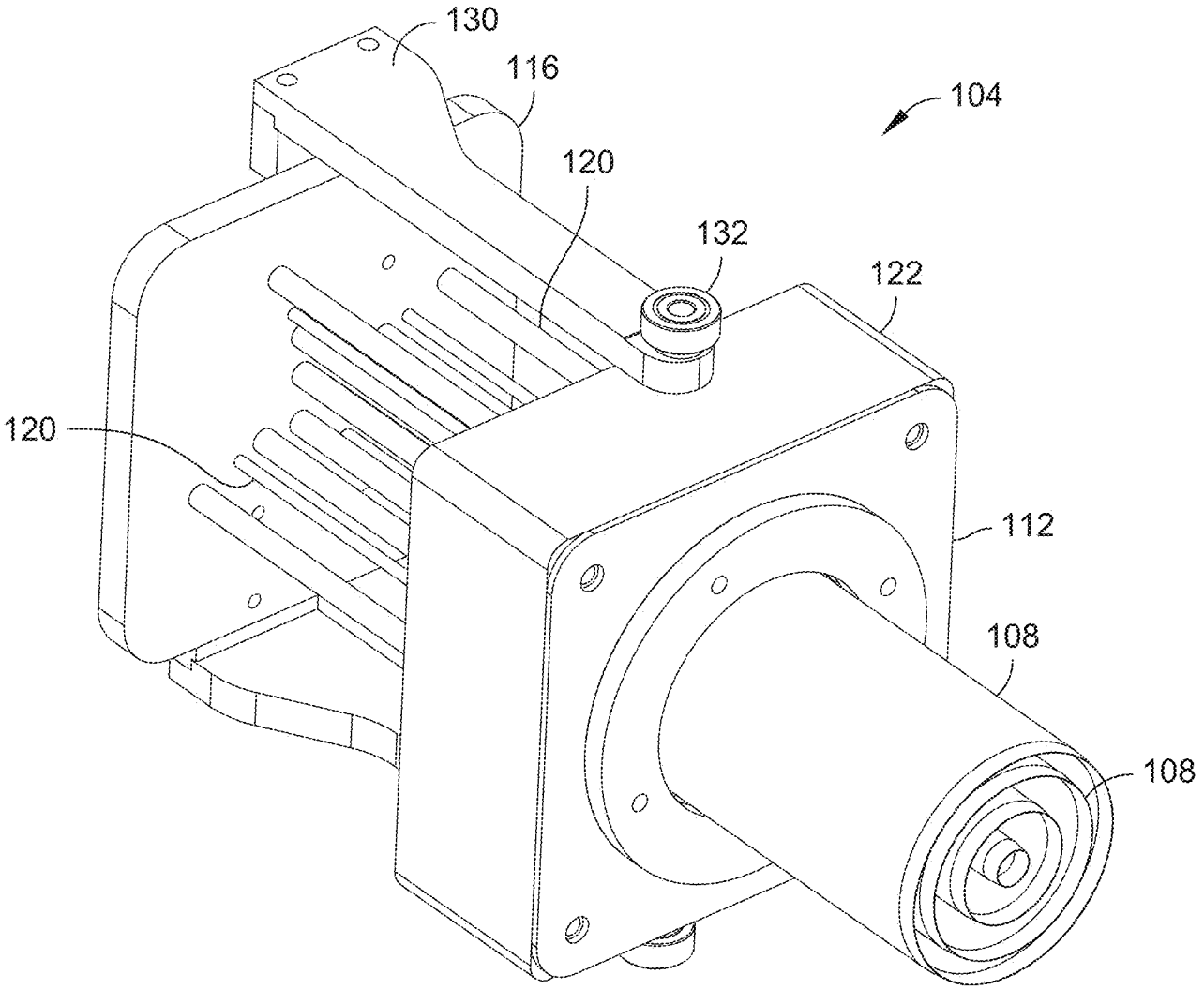
FIG. 5 is an isometric view of a food cutter including a stack of ring knives and ejector plates for a food product cutting system, such as the food product cutting system illustrated in FIG. 1, where a cam is shown in a fully retracted orientation accordance with example embodiments of the present disclosure.
Figure 6:
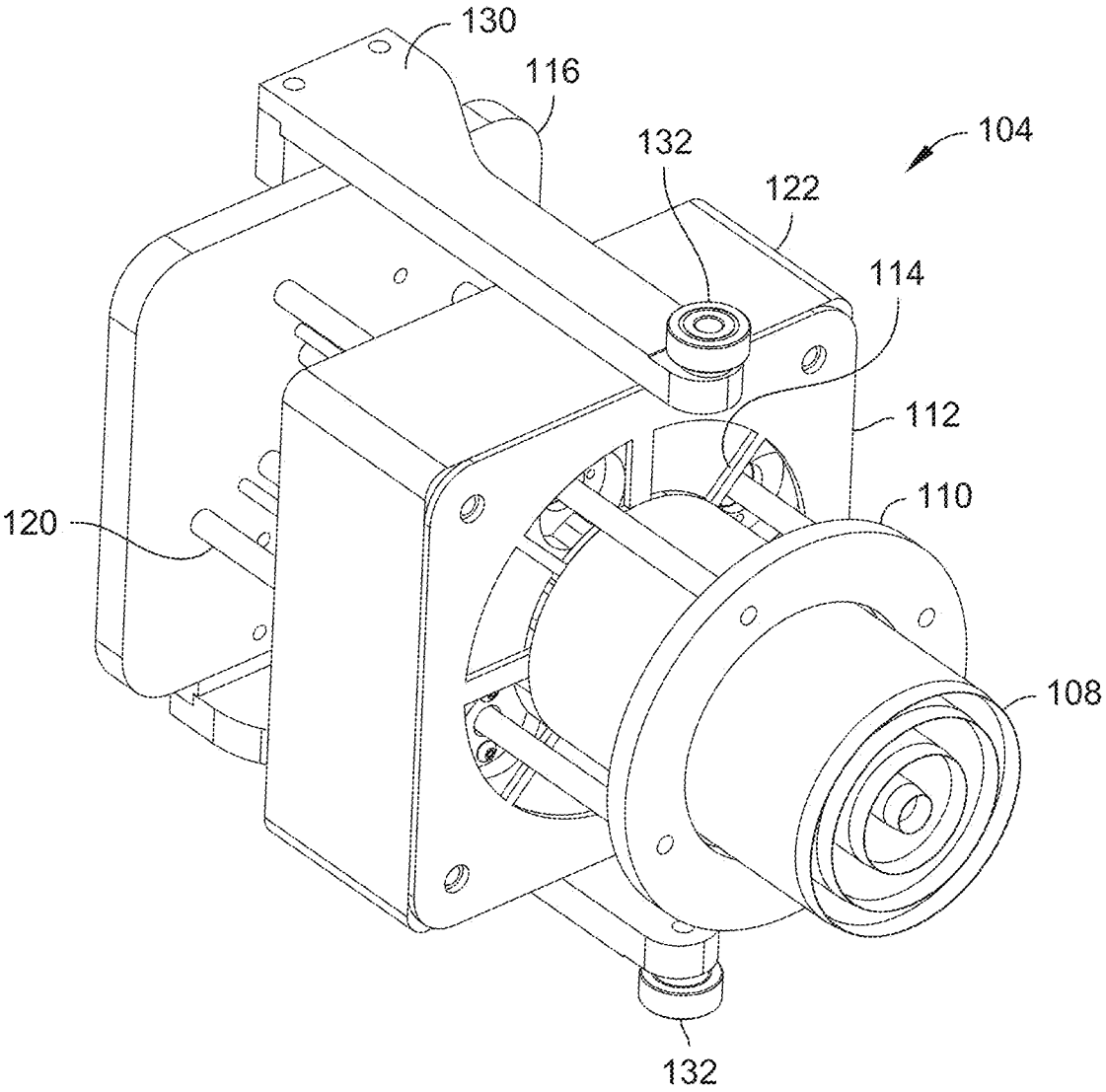
FIG. 6 is another isometric view of the food cutter illustrated in FIG. 5, where the cam is shown extending in the food cutter.
Figure 7:
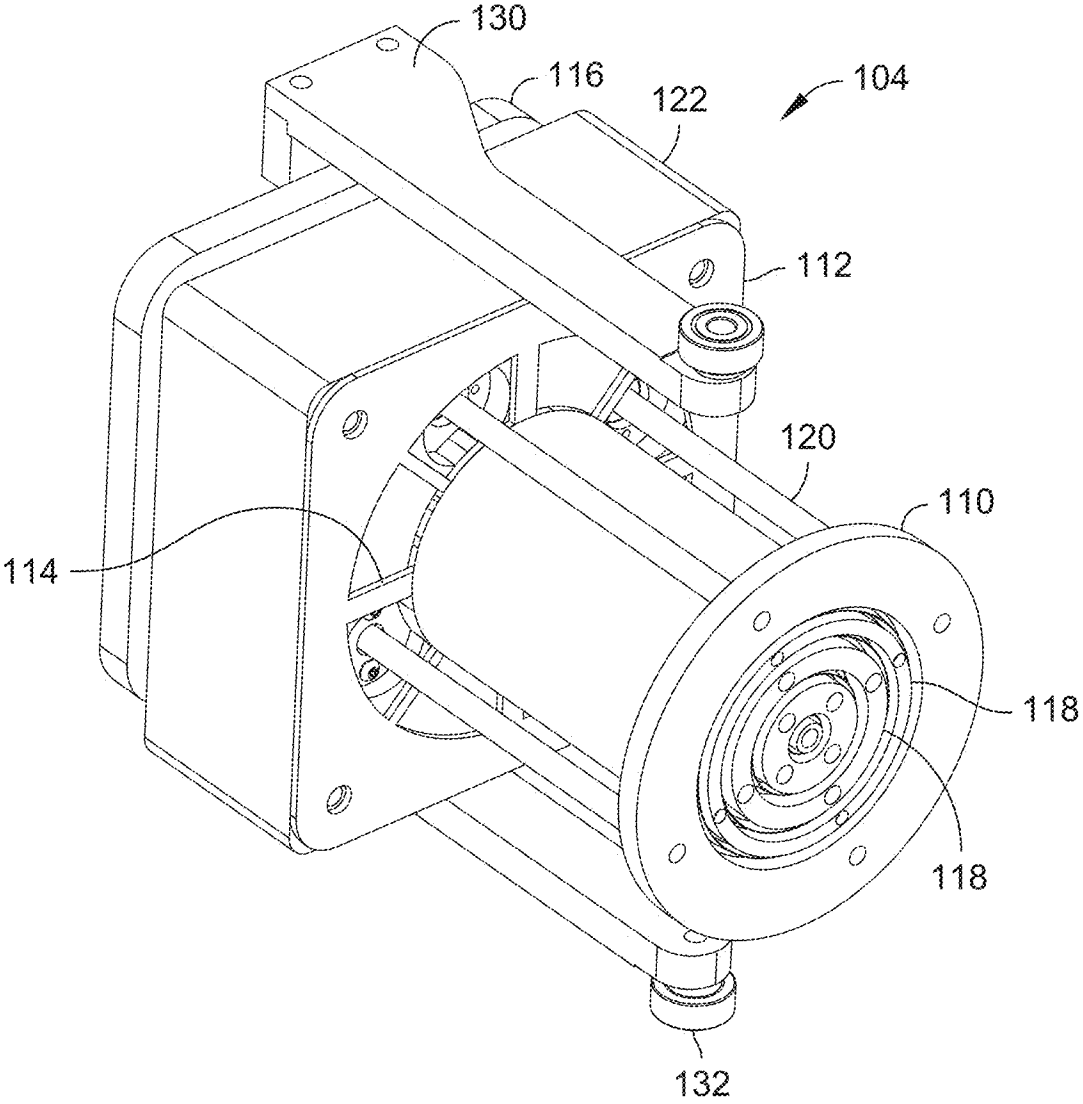
FIG. 7 is a further isometric view of the food cutter illustrated in FIG. 5, where the cam is shown in a fully extended orientation.
Figure 8:
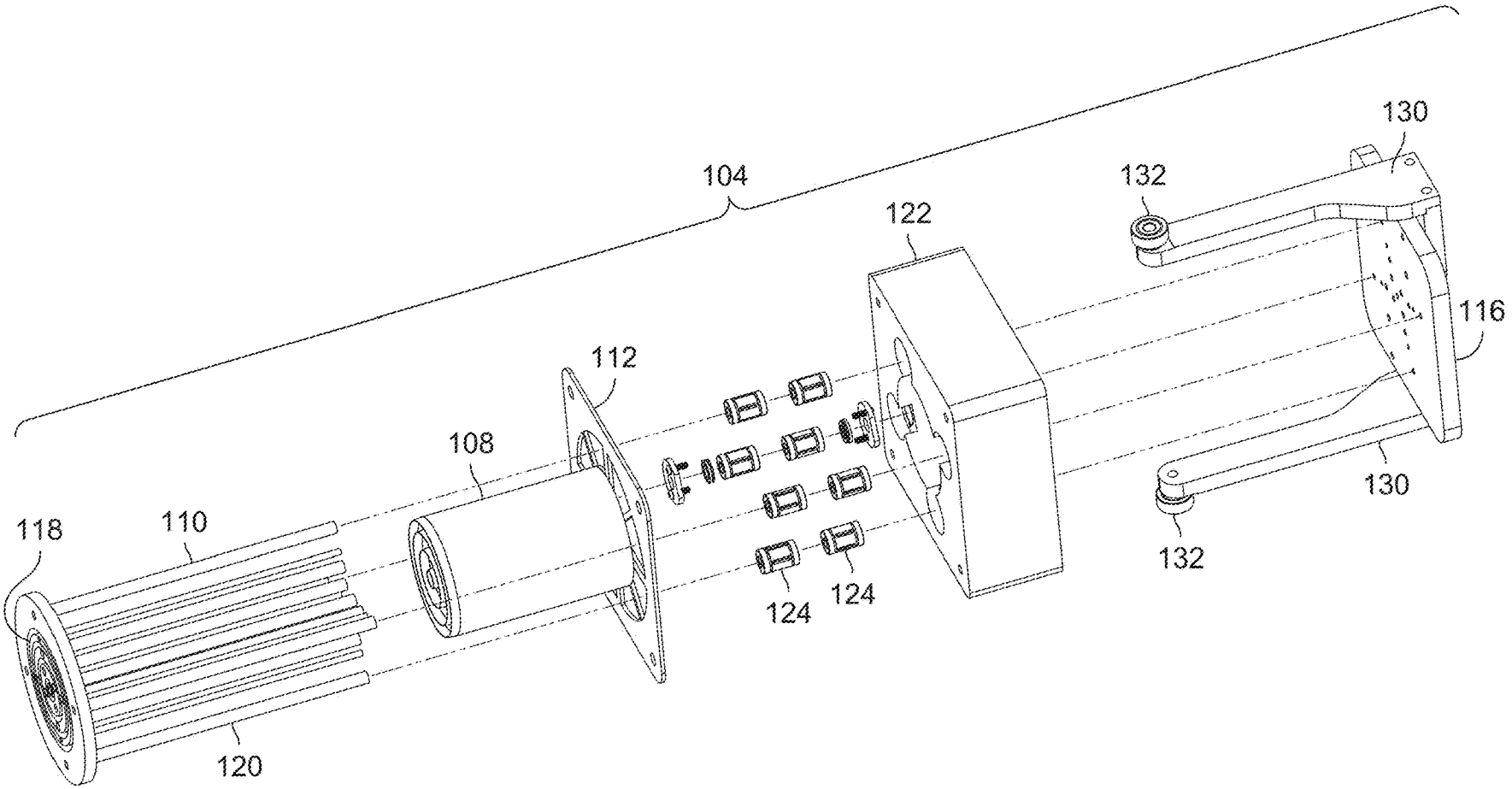
FIG. 8 is an exploded perspective view of the food cutter illustrated in FIG. 5.
Figure 11:
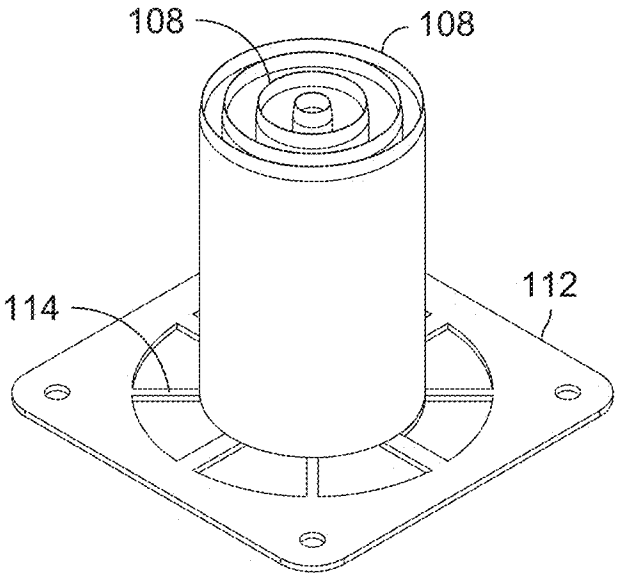
FIG. 11 is an isometric view of the knife weldment illustrated in FIG. 9.
Figure 9:
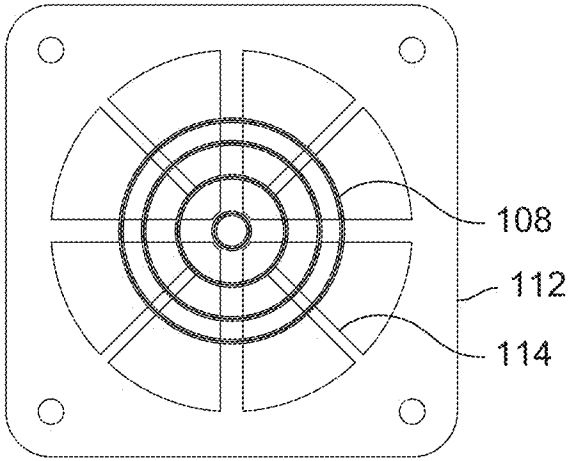
FIG. 9 is an end view illustrating a knife weldment for a food cutter, such as the food cutter illustrated in FIG. 5, in accordance with example embodiments of the disclosure.
Figure 10:
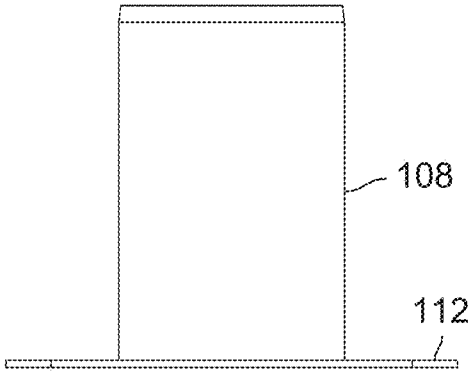
FIG. 10 is a side view of the knife weldment illustrated in FIG. 9.
Figure 14:
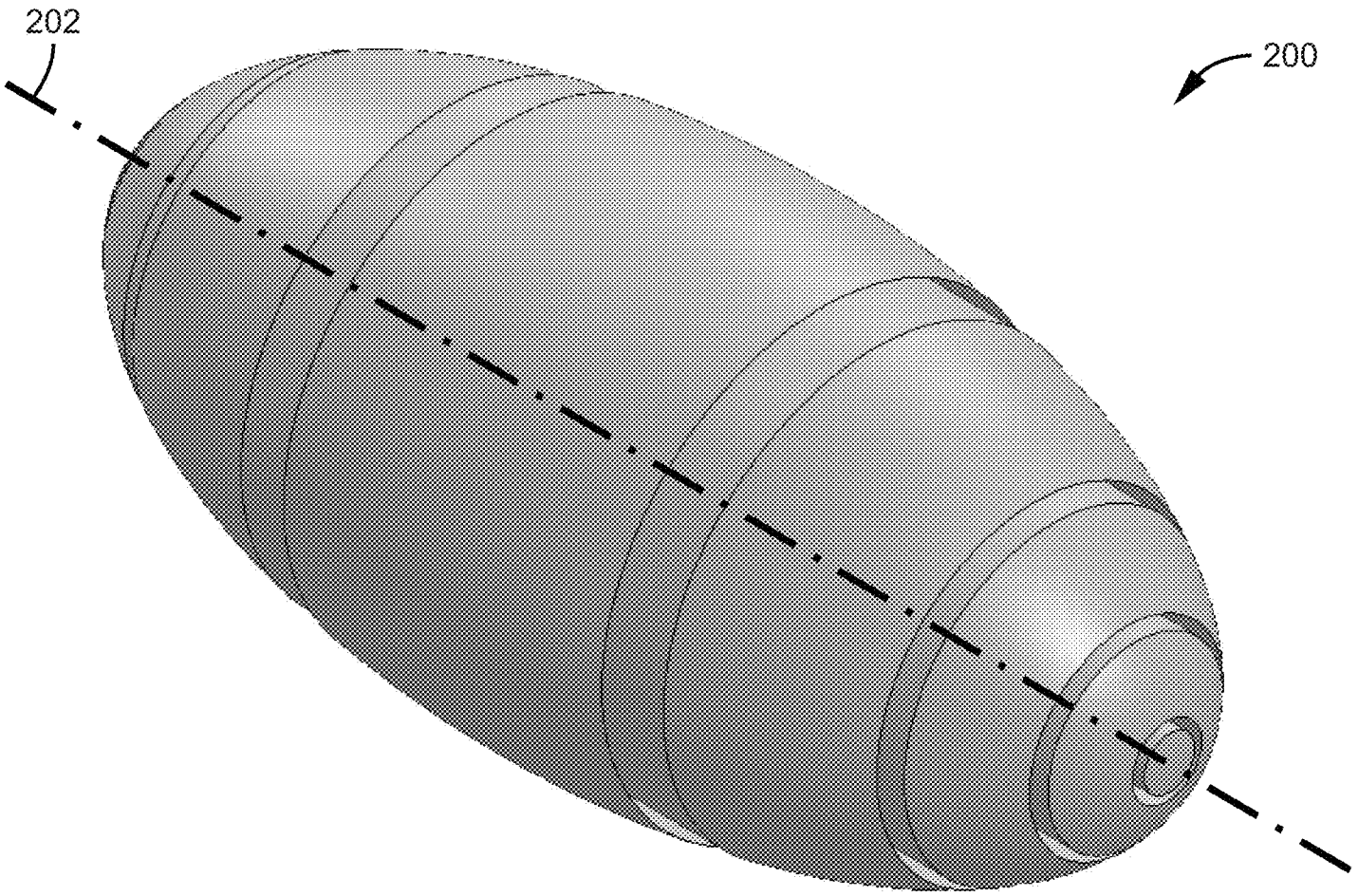

FIG. 14 is an isometric view illustrating a food product (potato) after a first cutting operation in a first direction (along a longitudinal axis of the potato) by a food product cutting system, such as the food product cutting system illustrated in FIG. 1, using a food cutter with a stack of ring knives, such as the food cutter illustrated in FIG. 5, in accordance with an example embodiment of the present disclosure.

Figure 15:
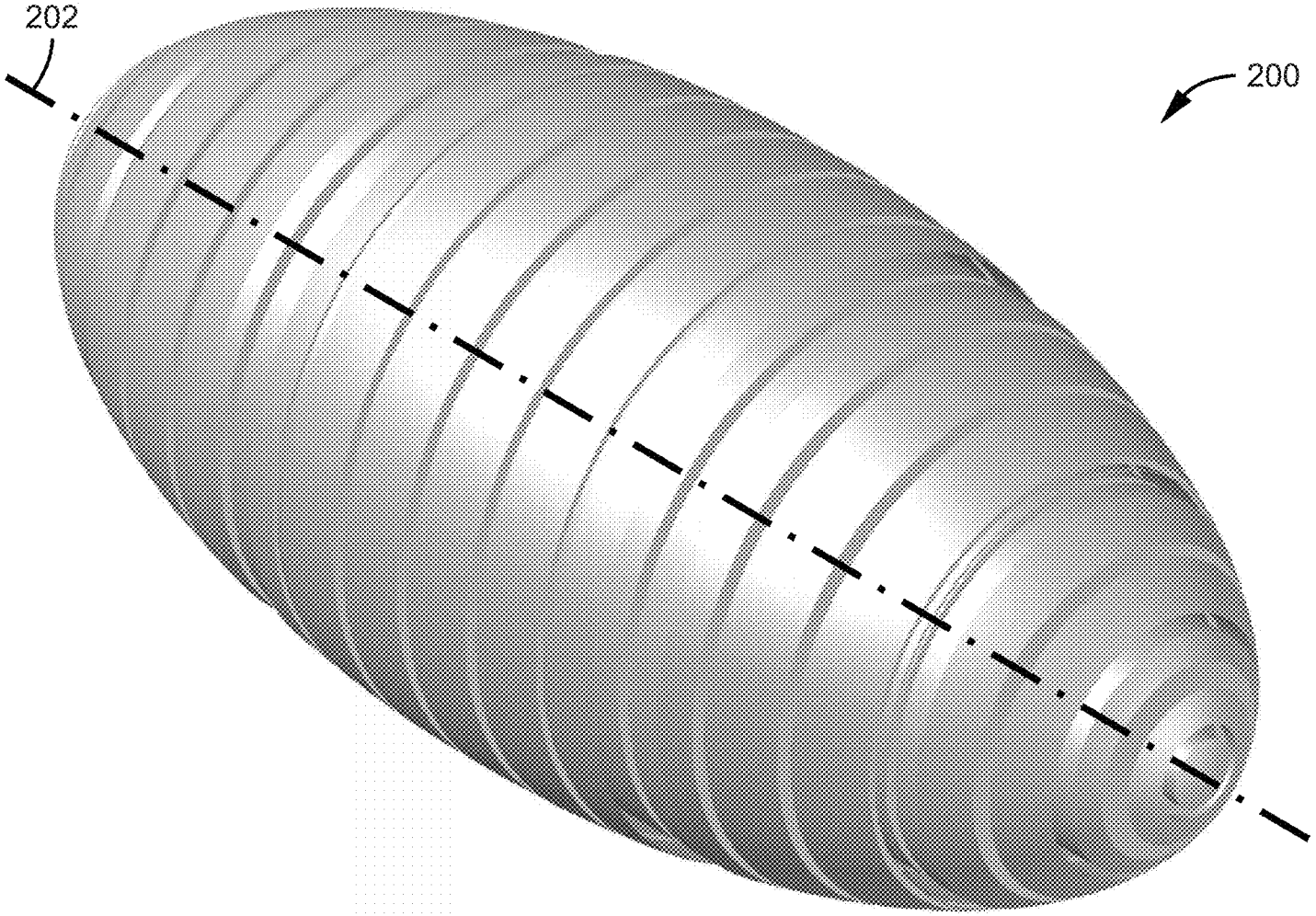

FIG. 15 is an isometric view illustrating the food product of FIG. 14 after multiple second cutting operations in a second direction (e.g., perpendicular to the longitudinal axis of the potato), in accordance with an example embodiment of the present disclosure.

Figure 16:
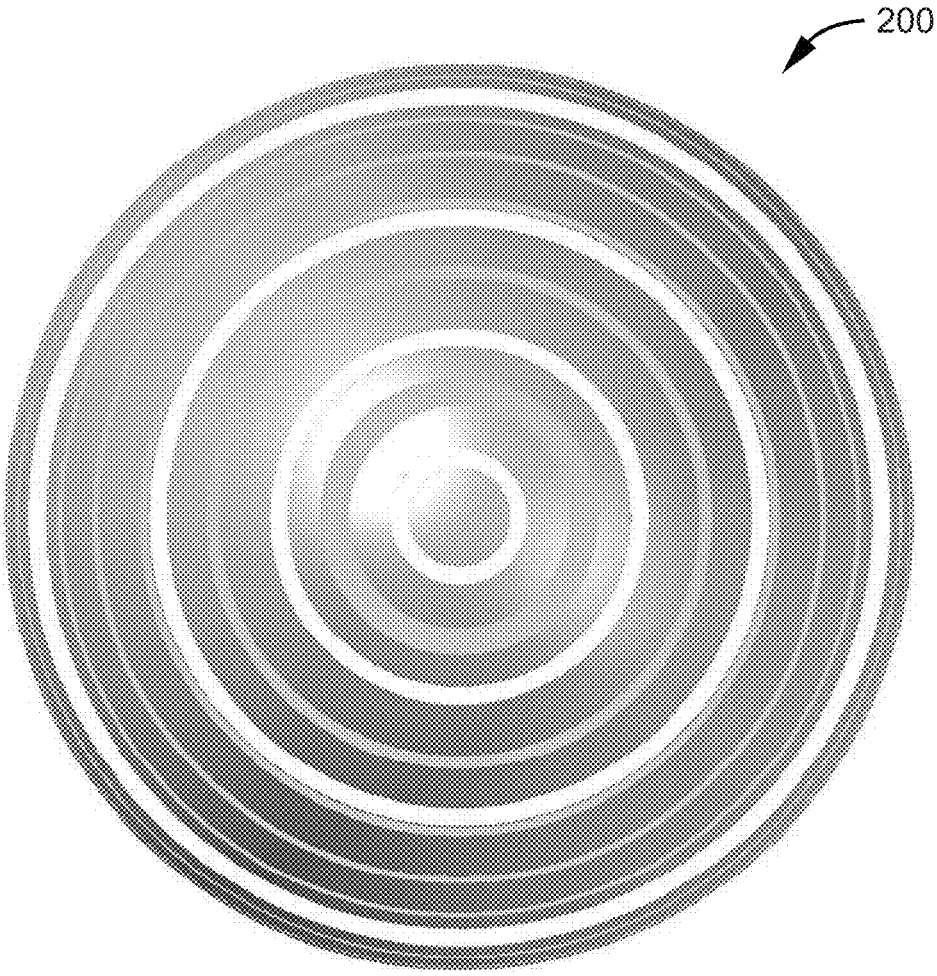

FIG. 16 is an end view of the food product illustrated in FIG. 15.

Figure 17:
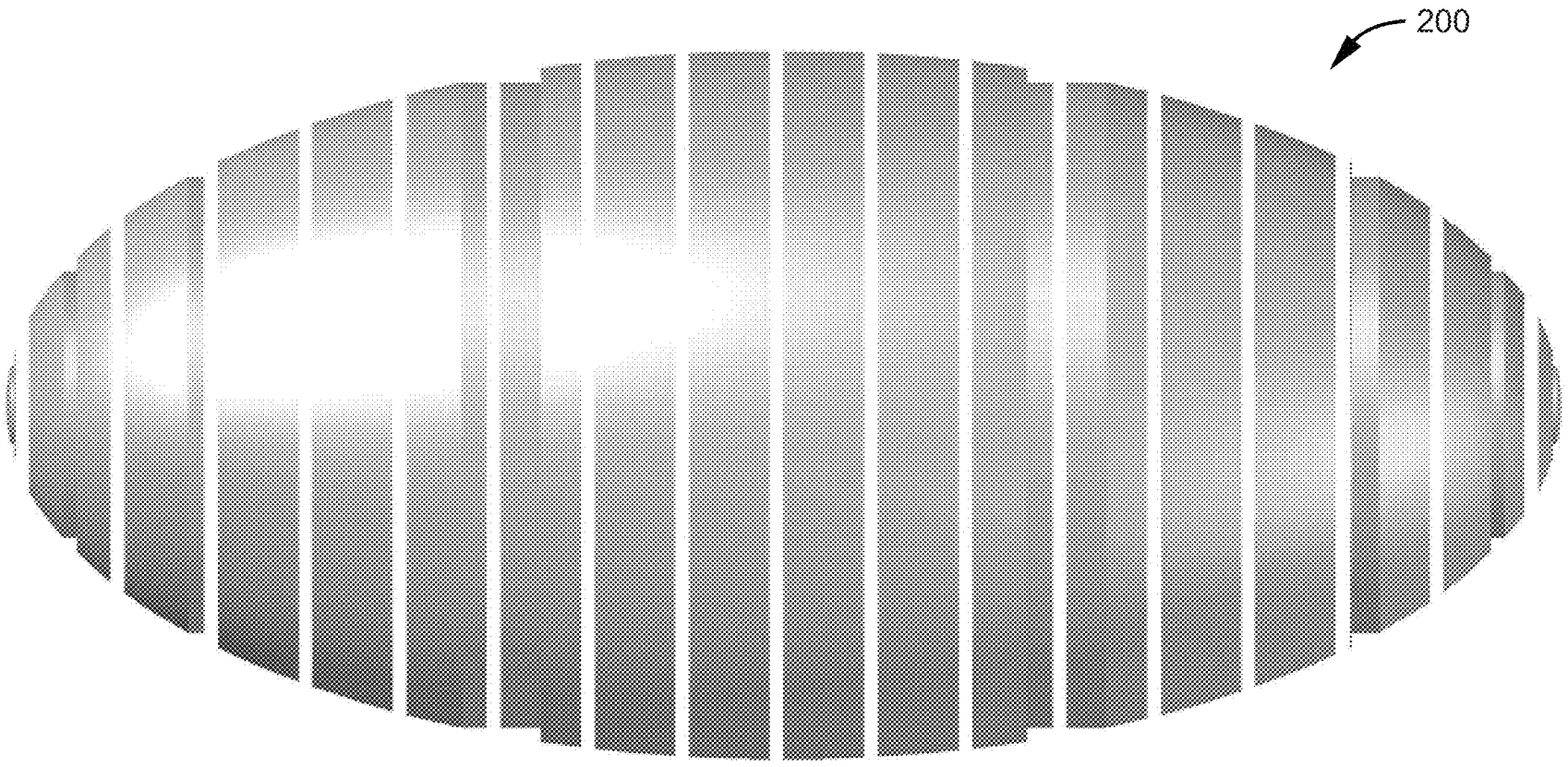

FIG. 17 is a side view of the food product illustrated in FIG. 15.

Figure 18:
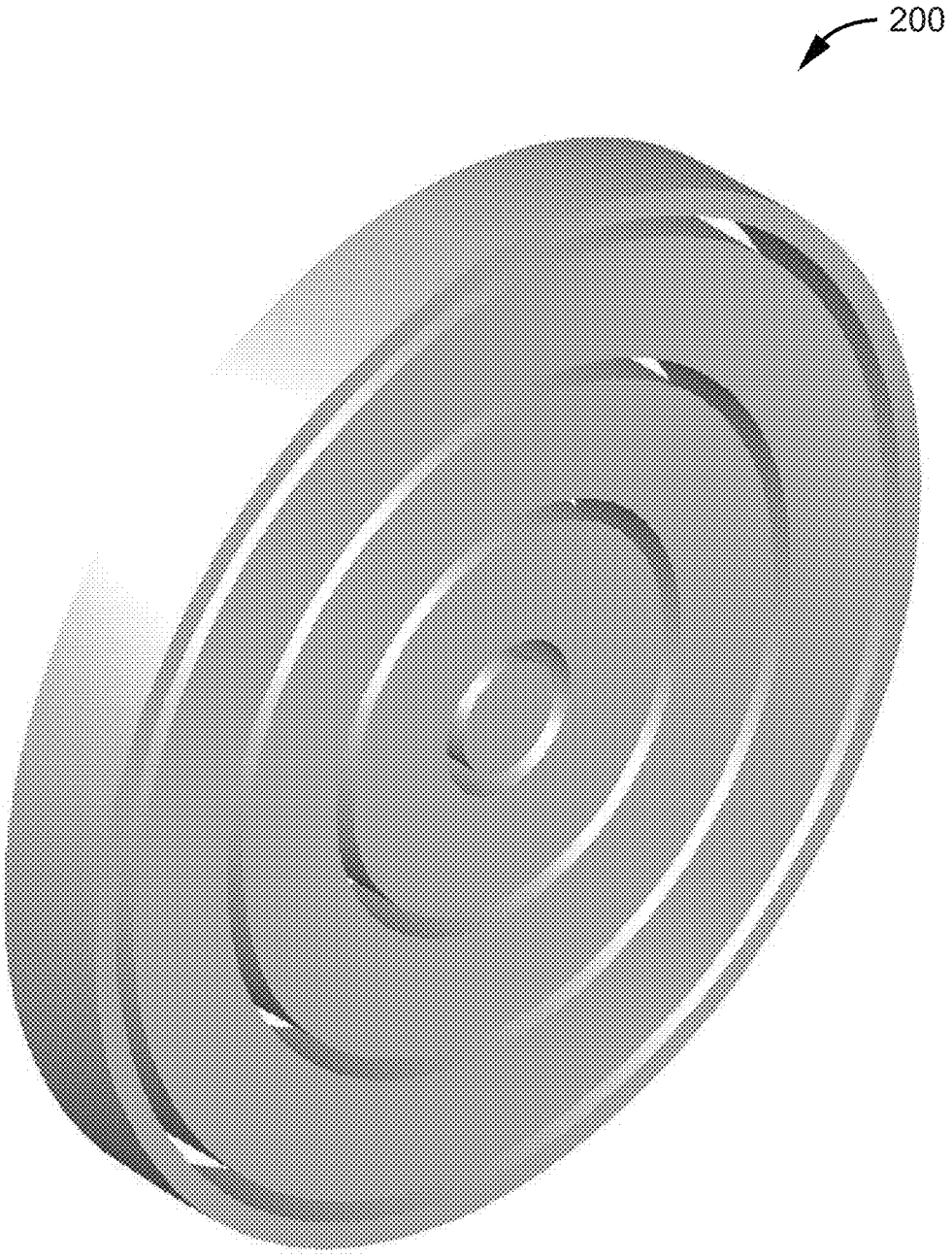

FIG. 18 is an isometric view of multiple pieces of food product after first and second cutting operations by a food product cutting system, such as the food product cutting system illustrated in FIG. 1, in accordance with an example embodiment of the present disclosure.

Figure 12:
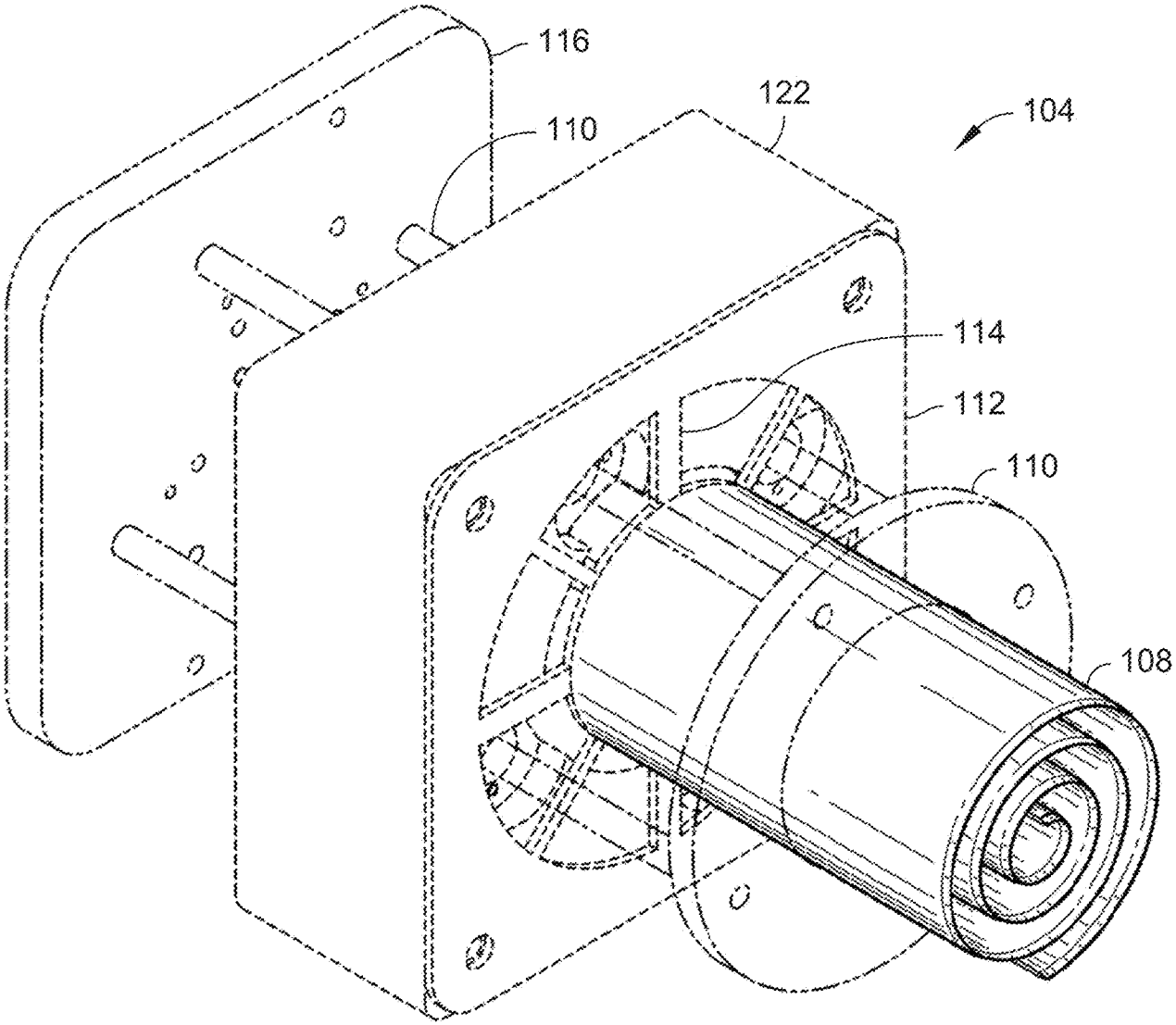
FIG. 12 is an isometric view of another food cutter including a spiral knife and ejector plate (shown in phantom) for a food product cutting system, such as the food product cutting system illustrated in FIG. 1.
Figure 19:
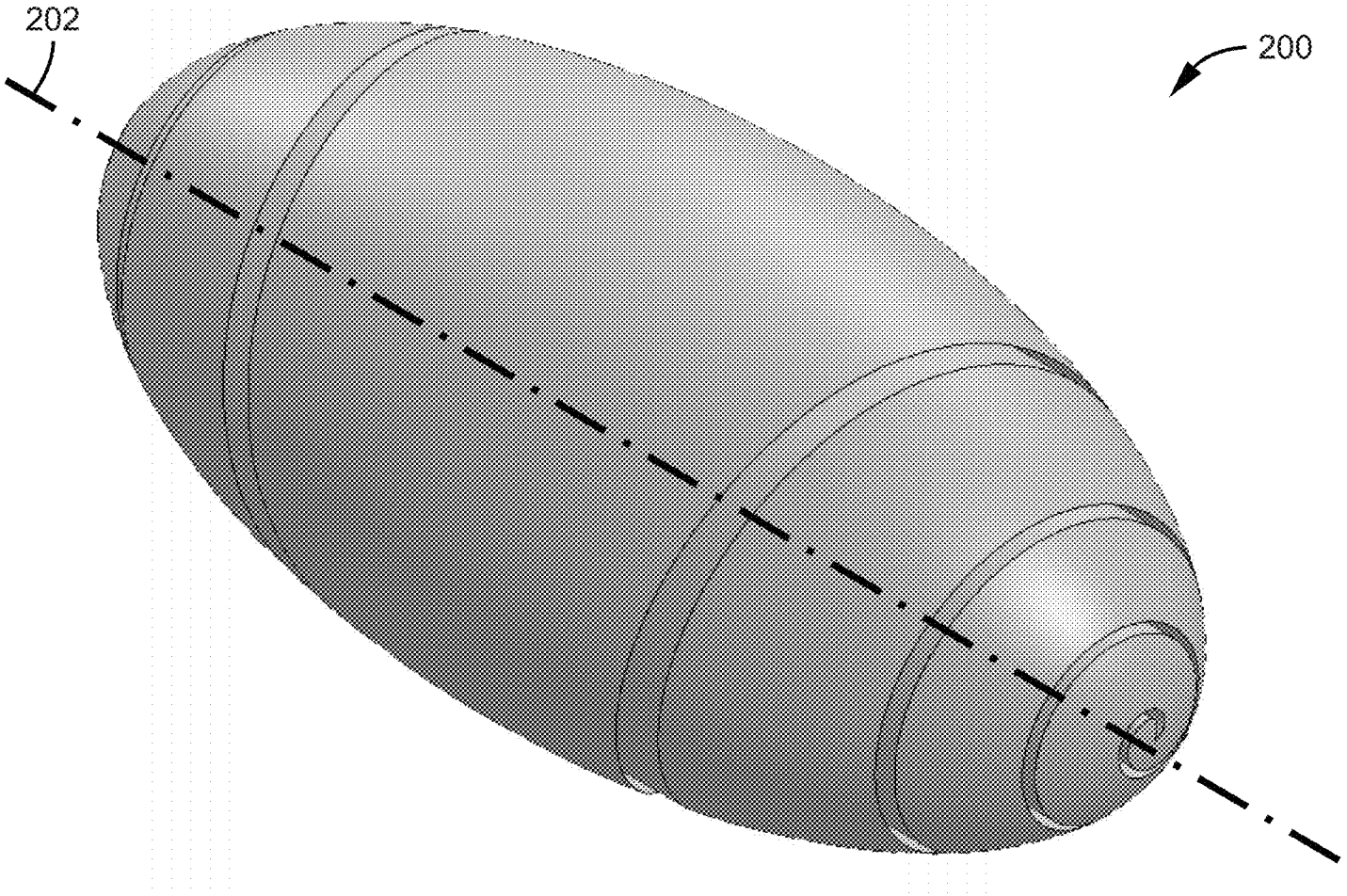

FIG. 19 is an isometric view illustrating a food product (potato) after a first cutting operation in a first direction (along a longitudinal axis of the potato) by a food product cutting system, such as the food product cutting system illustrated in FIG. 1, using a food cutter with a spiral knife, such as the food cutter illustrated in FIG. 12, in accordance with an example embodiment of the present disclosure.

Figure 20:
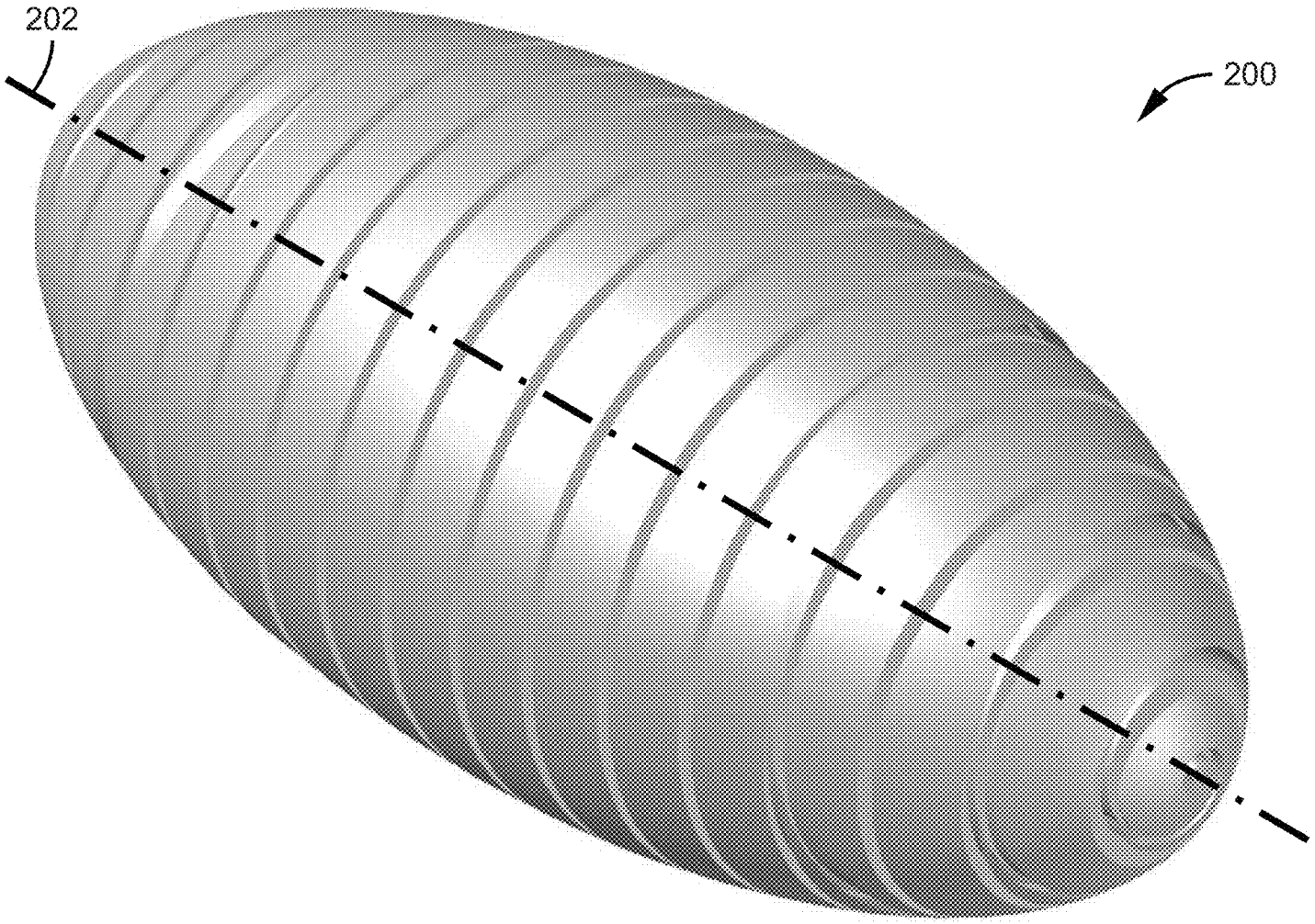

FIG. 20 is an isometric view illustrating the food product of FIG. 19 after multiple second cutting operations in a second direction (e.g., perpendicular to the longitudinal axis of the potato), in accordance with an example embodiment of the present disclosure.

Figure 21:
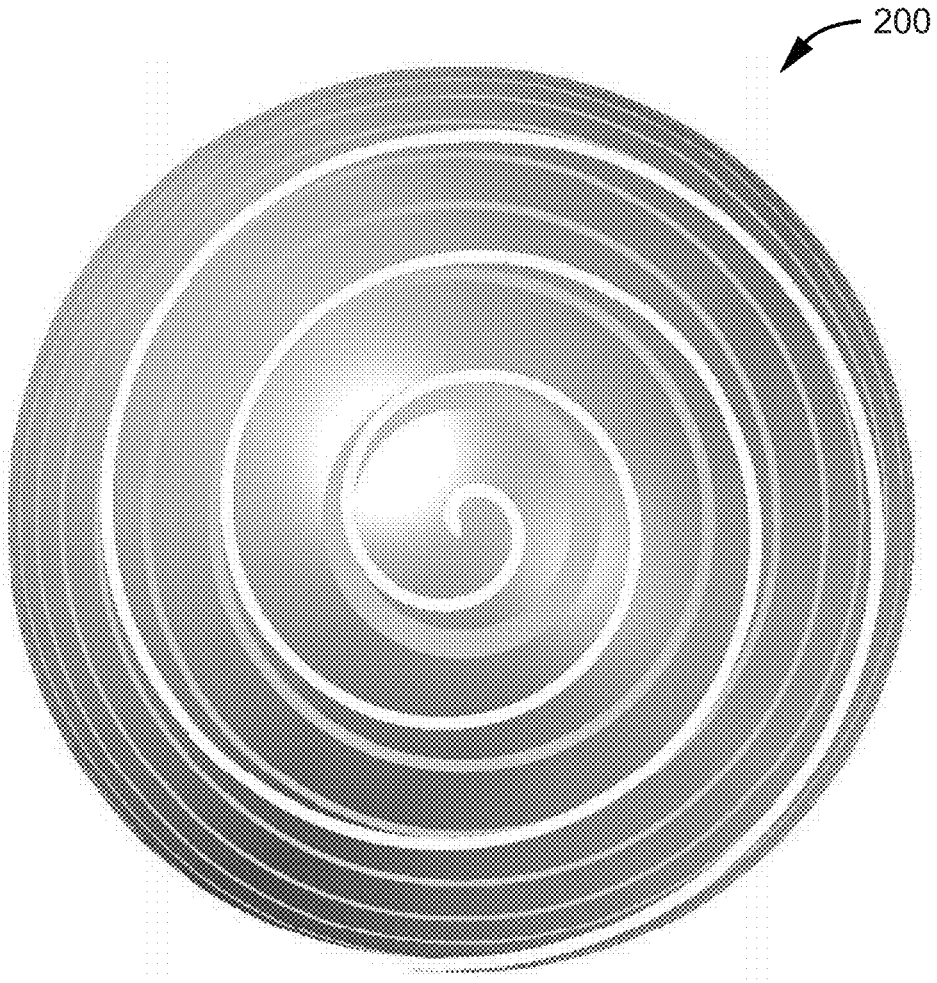

FIG. 21 is an end view of the food product illustrated in FIG. 20.

Figure 22:
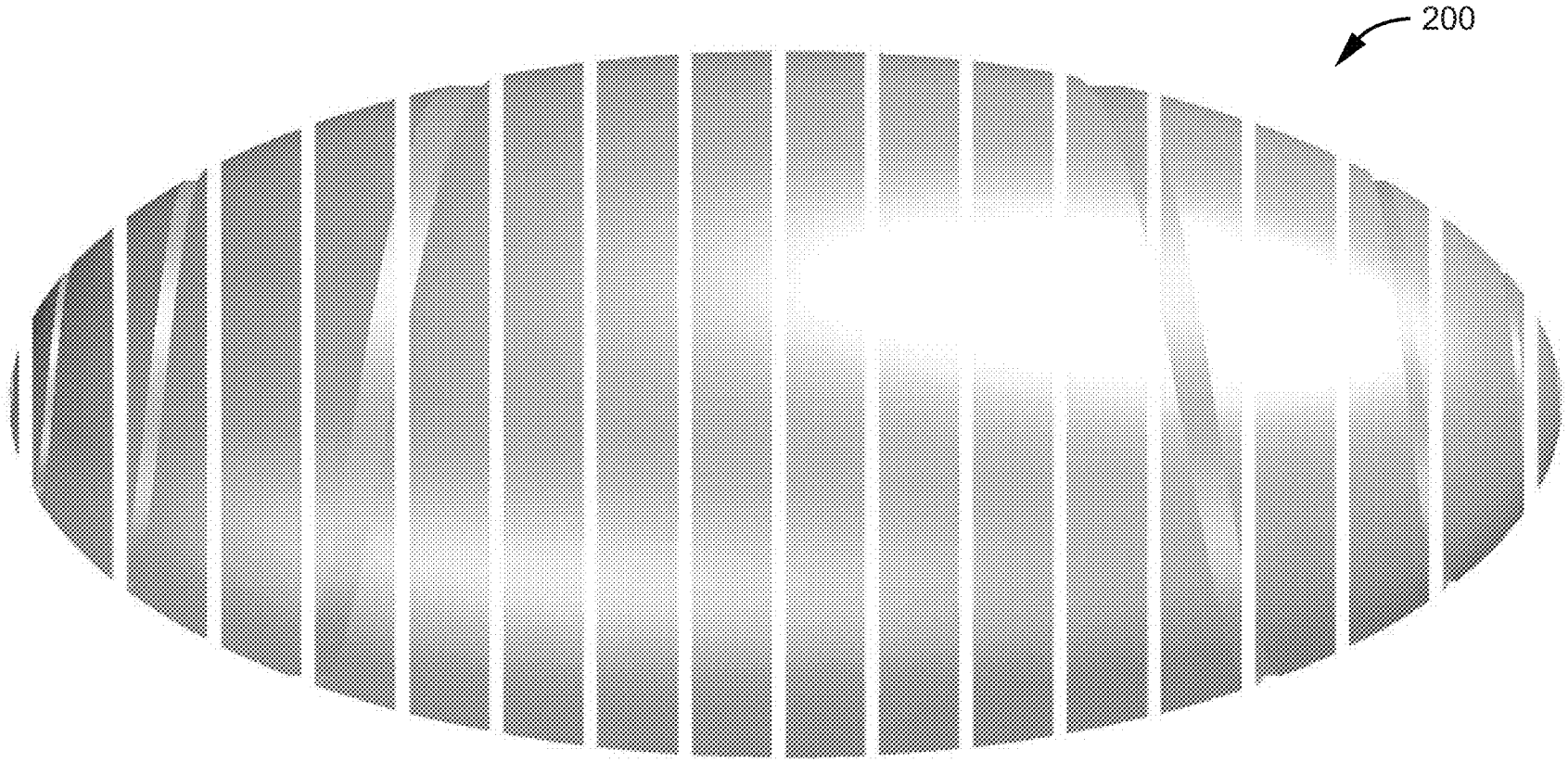

FIG. 22 is a side view of the food product illustrated in FIG. 20.

Figure 23:
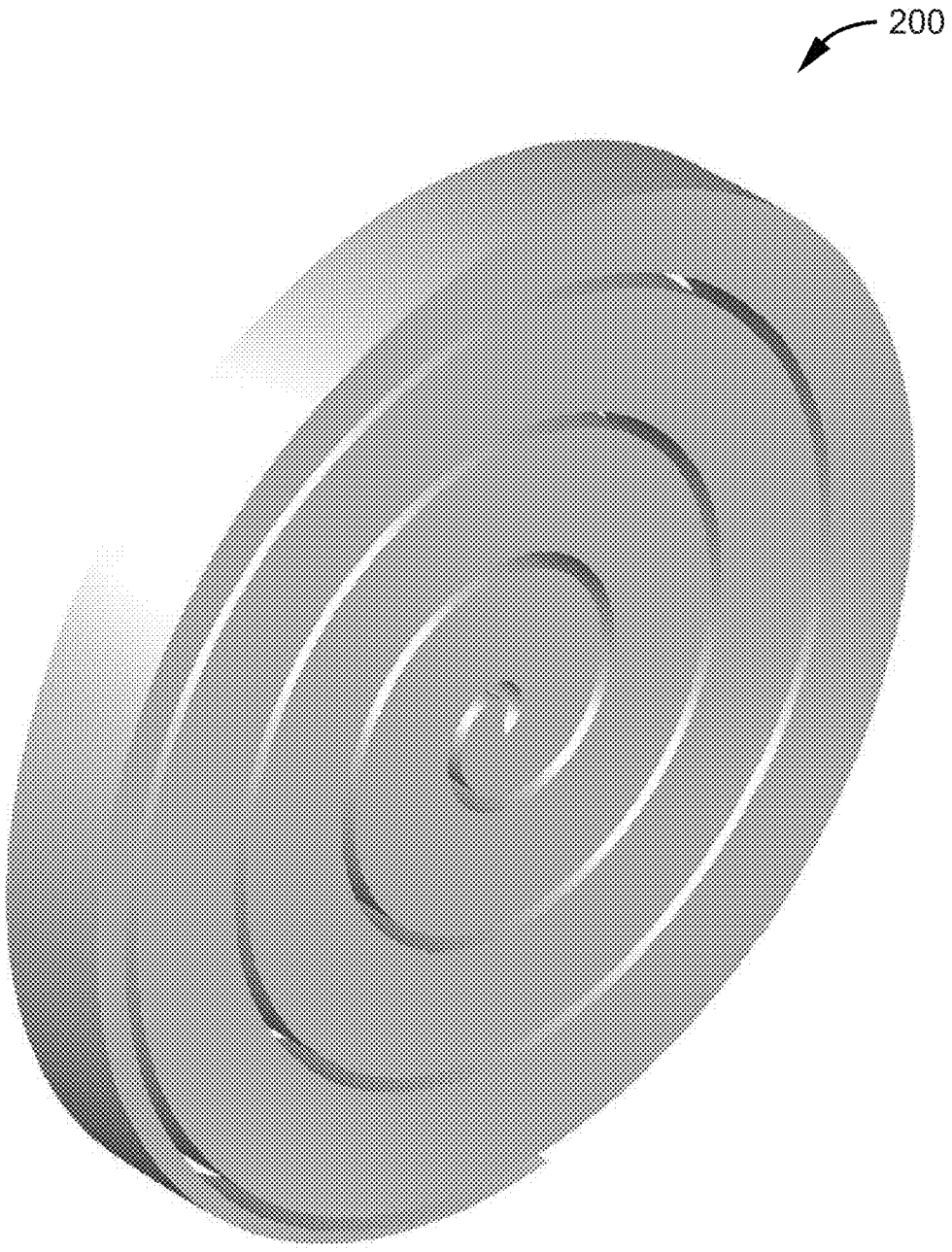

FIG. 23 is an isometric view of a piece of food product after first and second cutting operations by a food product cutting system, such as the food product cutting system illustrated in FIG. 1, in accordance with an example embodiment of the present disclosure.

Figure 24:
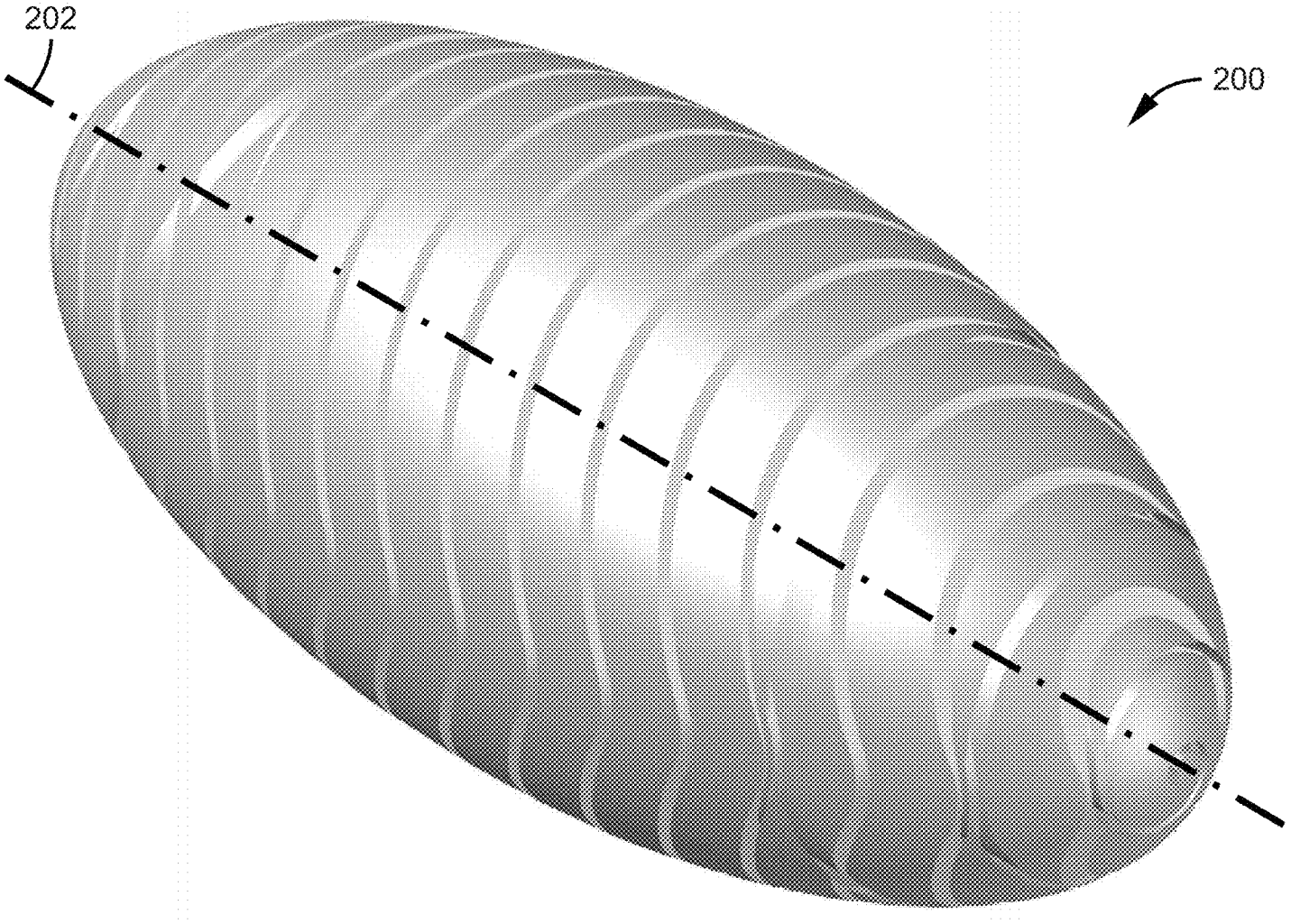

FIG. 24 is an isometric view illustrating the food product of FIG. 19 after multiple second cutting operations in a second direction (e.g., perpendicular to the longitudinal axis of the potato), in accordance with an example embodiment of the present disclosure.

Figure 25:
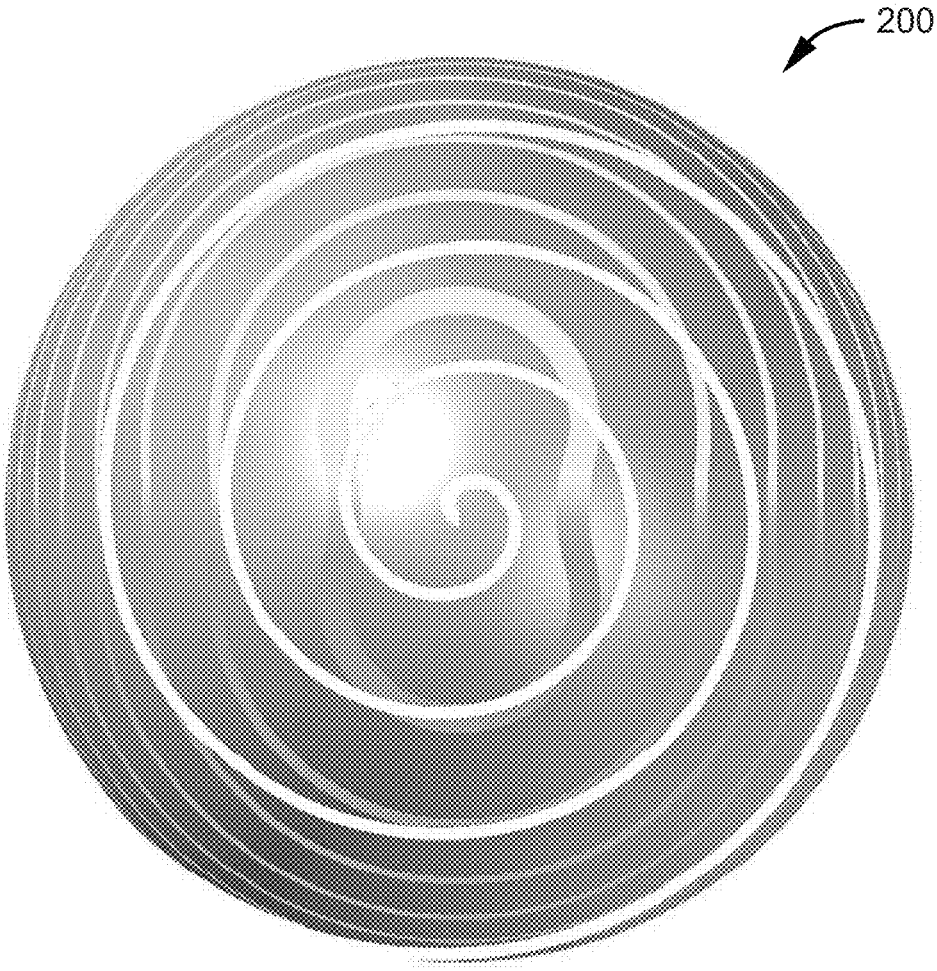

FIG. 25 is an end view of the food product illustrated in FIG. 24.

Figure 26:
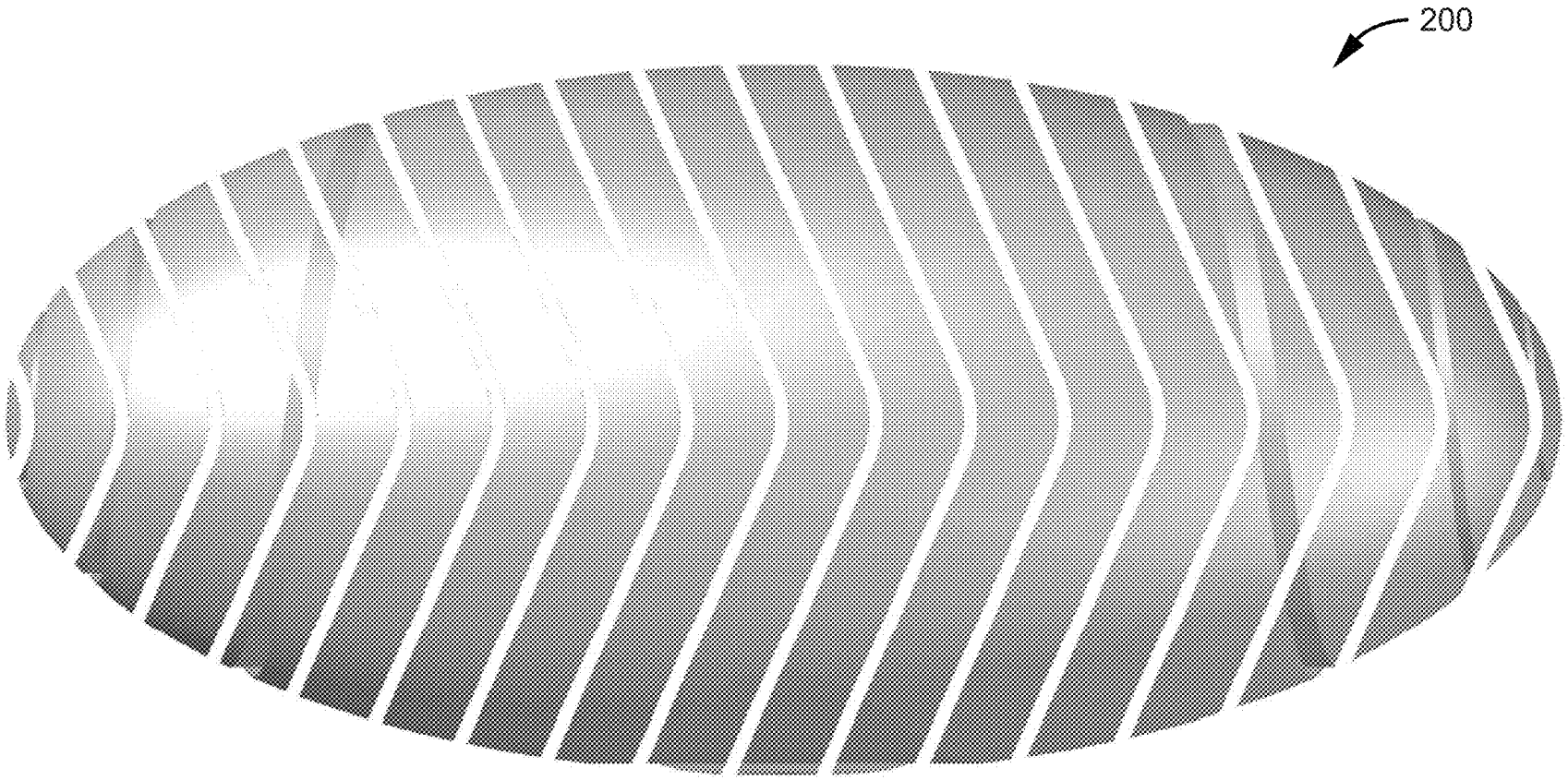

FIG. 26 is a side view of the food product illustrated in FIG. 24.

Figure 27:
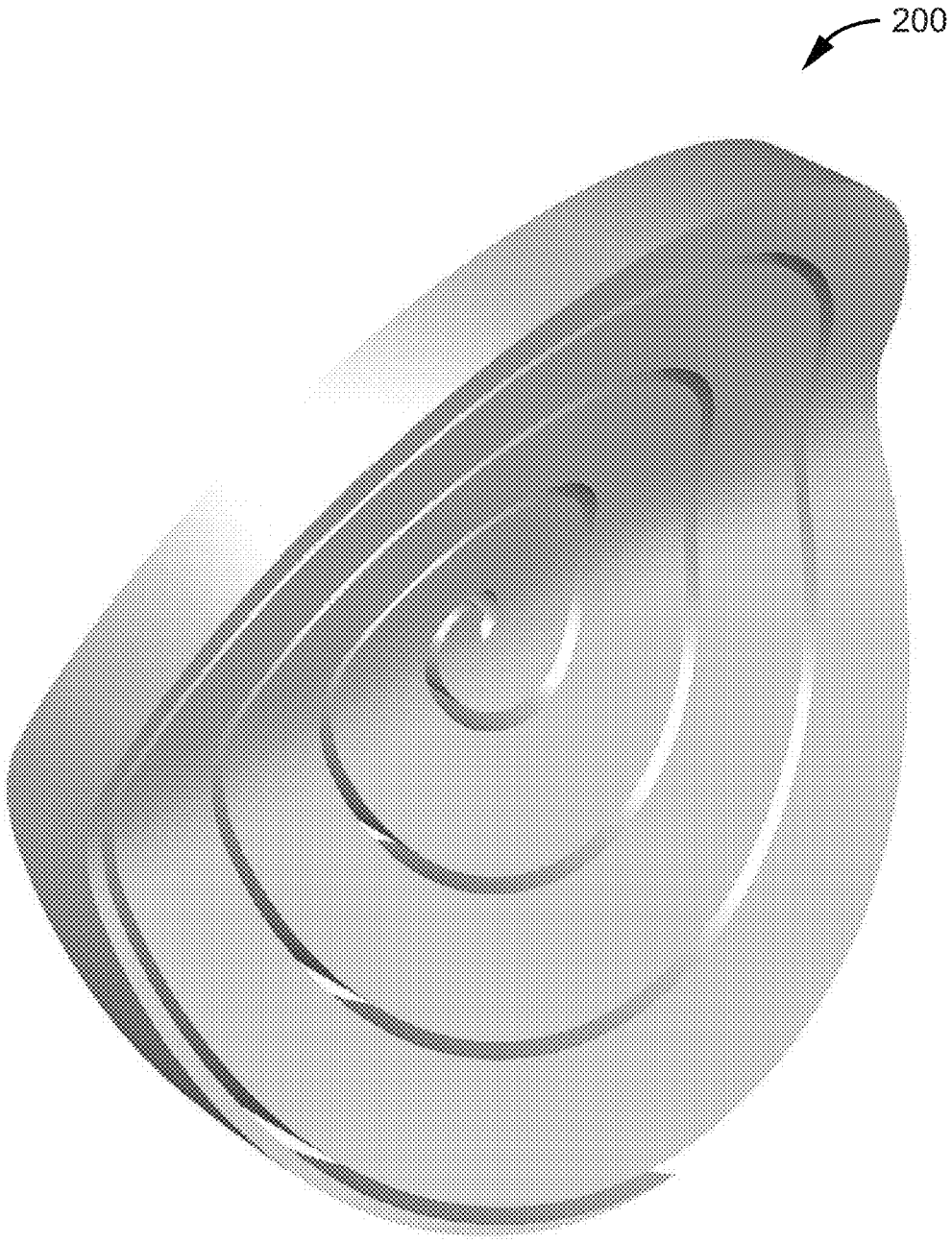

FIG. 27 is an isometric view of a piece of food product after first and second cutting operations by a food product cutting system, such as the food product cutting system illustrated in FIG. 1, in accordance with an example embodiment of the present disclosure.

DETAILED DESCRIPTION

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. Among other things, the features of the disclosure can be embodied as formulations, food products, processes, processes for making food products, and processes for making formulations. The following detailed description is, therefore, not to be taken in a limiting sense.

Referring generally to FIGS. 1 through 27, hydro-mechanical food product cutting systems 100 are described. A food product cutting system 100 can include a food product carrier 102 for carrying food product 200, where the food product carrier 102 includes one or more food cutters 104 for cutting food product 200. Example food products 200 for cutting can include, but are not necessarily limited to vegetables, such as potatoes. However, the disclosure herein shall be understood to include all vegetables and shall not be limited to potatoes. A few examples of other vegetables include sweet potatoes, yams, beets, and carrots. In addition, the term "vegetable" shall be understood to include fruits having a flesh density suitable for cutting by a cutter or knife. For example, apples, pears, and pineapples are several fruits that may be cut and/or processed by a cutter or knife. In some embodiments, a vegetable may be chilled, heated, and/or otherwise subjected to one or more pre-processing steps to provide an appropriate hardness, softness, and/or density for subsequent cutting by a cutter or knife.

As described, vegetables can be cut by the food cutter(s) 104 in a first direction (e.g., along a longitudinal axis 202 of a potato, as illustrated in FIGS. 14 and 19) and then in a second direction (e.g., perpendicular to the longitudinal axis 202 of the potato, as illustrated in FIGS. 15, 20, and 24). For example, one or more shapes (e.g., a spiral shape, multiple rings) can be cut along the axial length of a potato, and then the potato can be sliced into individual pieces. In some embodiments, the slices can be flat, or at least substantially flat. In other embodiments, the slices can have different shapes (e.g., a C-shape, a V-shape, a W-shape, etc.).

Figure 13:
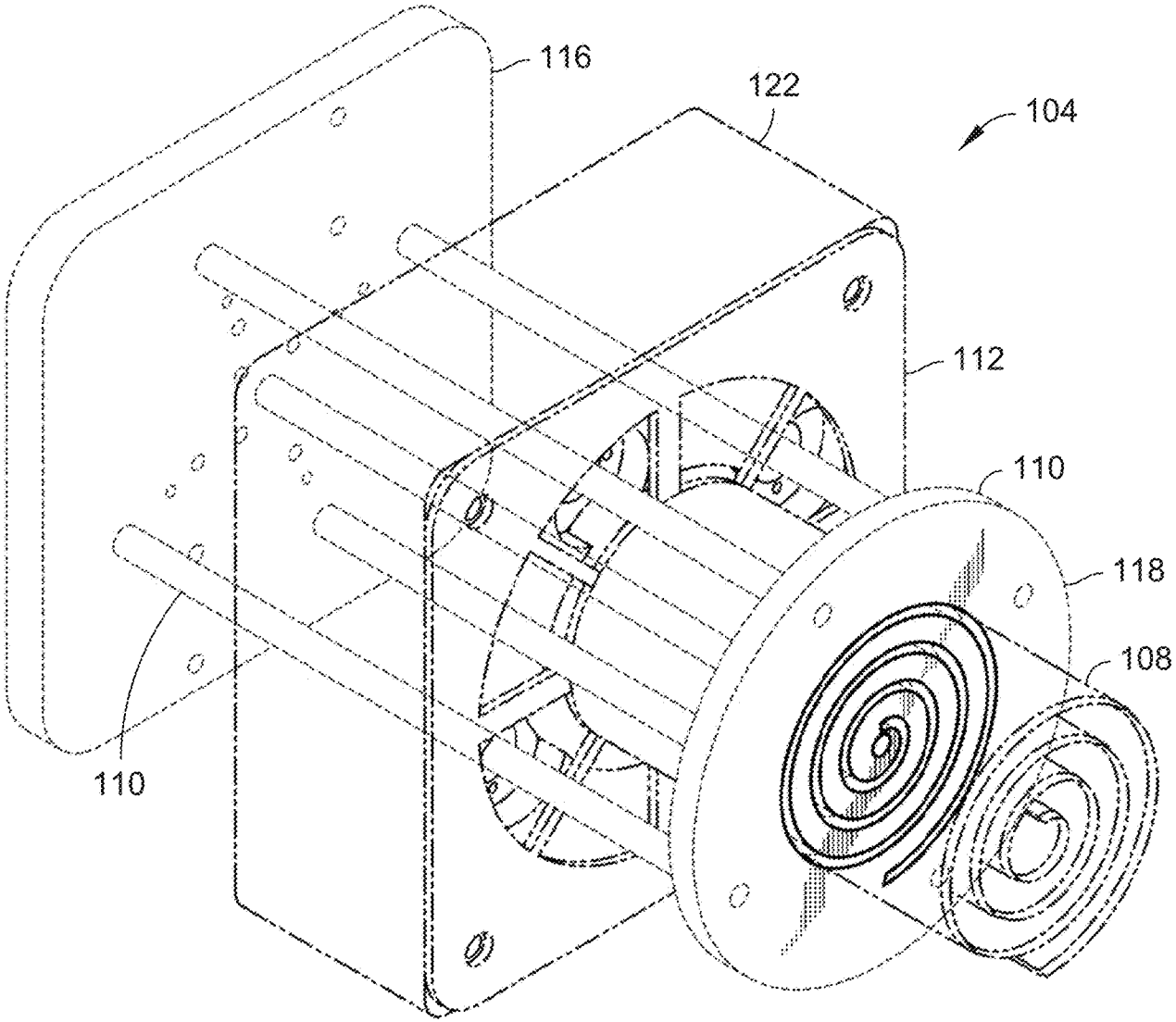
FIG. 13 is another isometric view of the food cutter illustrated in FIG. 12, where the spiral knife is shown in phantom.

Components of the food product carrier 102 can be arranged circumferentially around an axis of rotation 106. Each food cutter 104 can have one or more cutting elements or knives 108 (e.g., ring knives 108 as illustrated in FIGS. 5 through 11, a spiral knife 108 as illustrated in FIGS. 12 and 13) and a corresponding pusher 110 facing radially outward from the axis of rotation 106 of the food product carrier 102. The knife 108 of the food cutter 104 is configured to receive and engage with the food product 200, and each pusher 110 can be slidably coupled with its respective knife 108 and radially movable with respect to the axis of rotation 106 of the food product carrier 102 for pushing the food product 200 out of engagement with the food cutter 104.

In some embodiments, one or more knives 108 can be supported by a mounting plate 112. The knives 108 can be fastened (e.g., bolted, welded) to ribs 114 of the mounting plate 112. For example, ring knives 108 can be tack welded to ribs 114 of a mounting plate 112. Additionally, various components of the pusher 110 can be supported by another mounting plate 116. For example, the pusher 110 can include one or more ejector plates 118 connected to the mounting plate 116 by elongate supports/guide rods 120. The guide rods 120 and the ejector plate(s) 118 can be configured to travel between adjacent segments of a knife 108 (e.g., in the case of a spiral knife 108) and/or between multiple discrete knives 108 (e.g., in the case of a stack of ring knives 108).

In some embodiments, the mounting plate 112 can be supported by a mounting block 122 fixedly connected to the food product carrier 102, while the mounting plate 116 can be slidably coupled with the food product carrier 102. In some embodiments, the ejectors plate(s) 118 can be fixedly attached (e.g., bolted, welded) to the guide rods 120, and the guide rods 120 can be fixedly connected (e.g., bolted, welded) to the mounting plate 116. The guide rods 120 can also be slidably coupled with and supported by the mounting block 122 (e.g., using one or more bearings 124). It should be noted that the guide rods 120 and the ejector plate(s) 118 are provided by way of example and are not meant to limit the present disclosure. In other embodiments, different ejectors may be used, including ejector blocks that are mounted to a mounting plate 116 and move between adjacent segments of a knife 108 and/or between multiple discrete knives 108.

The food product 200 (e.g., a potato) can be moved from a food product supply device 126 (e.g., a tapered tube carrying a water-fed food product stream) and dispensed radially into engagement with the food cutters 104. In some embodiments, the water-fed product stream can be operated at between about nine hundred (900) gallons per minute (gpm) and about one thousand two hundred (1,200) gpm at pressures between about fifteen (15) pounds per square inch (psi) and about twenty (20) psi. In operation, the food product carrier 102 moves around the axis of rotation 106, pausing to allow the food product 200 to enter at the food cutter 104. In some embodiments, the food product carrier 102 can be paused for about one-half (0.5) second or more.

Then, the food product carrier 102 rotates, allowing the next food product 200 (e.g., another potato) to enter the next food cutter 104. In some embodiments, the food product carrier 102 can rotate at a rate of between about thirty (30) revolutions per minute (rpm) and about fifty rpm. As the food product carrier 102 rotates, an ejector (e.g., a cam) incrementally extends and pushes the potato out of engagement with the food cutter 104. For instance, a food product cutting system 100 can include one or more tracks 128 (e.g., an upper cam track, a lower cam track) oriented generally circularly with respect to the food product carrier 102 and about the axis of rotation 106. It should be noted that the operating ranges of the water-fed product stream and the pause time and rotation rate of the product carrier are provided by way of example and are not meant to limit the present disclosure. In other embodiments, food product cutting systems 100 can be operated at different flow rates, pressures, pause times, revolutions per minute, and so forth.

In embodiments, the track(s) 128 can be arranged at varying radial distances D1, D2, etc. (FIG. 2) from the axis of rotation 106 of the food product carrier 102. A track 128 can be coupled with one or more followers 130 (e.g., cam followers), each connected to a corresponding pusher 110 for pushing the food product 200. In embodiments, each follower 130 can be fixedly attached to a mounting plate 116 (e.g., bolted, welded) and can include a cam follower bearing 132 that engages with the cam track(s) 128. For instance, two followers 130, each with a cam follower bearing 132, can be fastened to a mounting plate 116 and engaged with the upper cam track 128 and the lower cam track 128. In example operations, the food product carrier 102 receives food product 200 at a food cutter 104. The food product 200 is moved into the knife 108 of a food cutter 104 and carried around the axis of rotation 106 in direction 134 (FIG. 2) as the corresponding pusher 110 pushes the food product 200 out of engagement with the food cutter 104.

In embodiments of the disclosure, the food product cutting system 100 includes one or more stationary slicing knives 136 disposed in a generally tangential orientation with respect to the direction of travel of the food cutters 104. The slicing knives 136 are configured for slicing the food product 200 as the food product carrier 102 rotates and the food product 200 is incrementally or gradually pushed out of engagement with the food cutter 104. In this manner, the food product 200 can be cut in the second direction (e.g., perpendicular to the longitudinal axis 202 of the potato) to form slices. The slicing knives 136 can have various blade shapes, including, but not necessarily limited to: straight blade shapes, curved or C-shaped blades, V-shaped blades, W-shaped blades and so forth. For instance, the potato shapes illustrated in FIGS. 24 through 27 are cut with a V-shaped blade. The slicing knives 136 can be mounted on a stationary mount bar 138. The food product cutting system 100 can also include a chute 140, and the cut food product 200 can be washed down the chute 140 and into a flume (not shown) by process water. The food product cutting system 100 can also include a cover (not shown) for enclosing the food product carrier 102 and the slicing knives 136 and containing the process water and food product 200.

It should be noted that while the description provided herein uses examples where the food product carrier 102 of the food product cutting system 100 rotates relative to stationary slicing knives 136 on a stationary track 128, these examples are not meant to limit the present disclosure. The terms "stationary" and "rotation" shall be understood to refer to the relative motions of the food product carrier 102 and the slicing knives 136 with respect to one another and not with respect to another frame of reference, such as the ground. For example, in other embodiments, the food product carrier 102 may be fixed in place with respect to the ground, and the slicing knives 136 may rotate around an axis of rotation with respect to the ground. In other embodiments, both the food product carrier 102 and the slicing knives 136 may move with respect to another frame of reference, such as the ground.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A food product cutting system for cutting vegetable food product first along an axis of the food product and then at least generally perpendicularly to the axis of the food product, the food product cutting system comprising:

a food product carrier for carrying the food product circumferentially around an axis of rotation, the food product carrier including a plurality of food cutters each having a knife and a corresponding pusher facing radially outward from the axis of rotation, the knife for receiving and engaging with food product, the pusher slidably coupled with the knife and radially movable for pushing food product out of engagement with the food cutter;

a track oriented generally circularly with respect to the food product carrier and about the axis of rotation, the track arranged at varying radial distances from the axis of rotation and coupled with a plurality of followers, each one of the plurality of followers connected to the corresponding pusher for pushing the food product, where food product moved into the knife of the food cutter and carried around the axis of rotation is gradually pushed out of engagement with the food cutter by the corresponding pusher; and a slicing knife disposed in a generally tangential orientation with respect to the plurality of food cutters for slicing the food product as the food product carrier rotates and the food product is gradually pushed out of engagement with the food cutter.

2. The food product cutting system as recited in claim 1, further comprising a food product supply device for dispensing food product radially into engagement with the plurality of food cutters.

3. The food product cutting system as recited in claim 2, wherein the food product supply device comprises a tapered tube configured to receive and deliver food product from a water-fed product stream.

4. The food product cutting system as recited in claim 1, wherein the knife comprises a spiral knife.

5. The food product cutting system as recited in claim 1, wherein the pusher comprises an ejector plate.

6. The food product cutting system as recited in claim 1, wherein the follower comprises a cam follower engaged with the track.

7. The food product cutting system as recited in claim 1, further comprising a chute for receiving cut food product from the food product carrier and the slicing knife.

8. A food product cutting system for cutting vegetable food product first along an axis of the food product and then at least generally perpendicularly to the axis of the food product, the food product cutting system comprising:

a food product carrier for carrying the food product circumferentially around an axis of rotation, the food product carrier including a food cutter having a knife and a pusher facing radially outward from the axis of rotation, the knife for receiving and engaging with food product, the pusher slidably coupled with the knife and radially movable for pushing food product out of engagement with the food cutter;

a track oriented generally circularly with respect to the food product carrier and about the axis of rotation, the track arranged at varying radial distances from the axis of rotation and coupled with a follower, the follower connected to the pusher for pushing the food product, where food product moved into the knife of the food cutter and carried around the axis of rotation is pushed out of engagement with the food cutter by the pusher; and a slicing knife disposed in a generally tangential orientation with respect to the food cutter for slicing the food product as the food product carrier rotates and the food product is gradually pushed out of engagement with the food cutter.

9. The food product cutting system as recited in claim 8, further comprising a food product supply device for dispensing food product radially into engagement with the food cutter.

10. The food product cutting system as recited in claim 9, wherein the food product supply device comprises a tapered tube configured to receive and deliver food product from a water-fed product stream.

11. The food product cutting system as recited in claim 8, wherein the knife comprises a spiral knife.

12. The food product cutting system as recited in claim 8, wherein the pusher comprises an ejector plate.

13. The food product cutting system as recited in claim 8, wherein the follower comprises a cam follower engaged with the track.

14. The food product cutting system as recited in claim 8, further comprising a chute for receiving cut food product from the food product carrier and the slicing knife.

* * * * *